US005462121A

United States Patent [19]

Schmuck et al.

[11] Patent Number: 5,462,121

[45] Date of Patent: * Oct. 31, 1995

[54] FAILSAFE LINER INSTALLATION ASSEMBLY AND METHOD

[75] Inventors: Phillip W. Schmuck, New Waverly; Steven R. Hayter, Houston; James R. Zachman, The Woodlands; John V. Salerni, Kingwood, all of Tex.

[73] Assignee: Baker Hughes Incorporated, Houston, Tex.

[ * ] Notice: The portion of the term of this patent subsequent to Nov. 1, 2011, has been disclaimed.

[21] Appl. No.: 238,064

[22] Filed: May 3, 1994

[51] Int. Cl.[6] ..... E21B 43/04

[52] U.S. Cl. ..... 166/383; 166/193; 166/387

[58] Field of Search ..... 166/383, 387, 166/123, 193, 228, 51

[56] References Cited

U.S. PATENT DOCUMENTS 5,360,069 11/1994 Schmuck et al. ..... 166/383

*Primary Examiner*—William P. Neuder

*Attorney, Agent, or Firm*—Rosenblatt & Redano

[57] ABSTRACT

An apparatus and method for installation of oil field tubulars, such as liners, is disclosed. The invention allows positioning of a liner with assurances that rotational forces or pressure applied within or outside the work string will not actuate the packer or the release assembly above the packer. Specific deliberate steps must be taken in order that rotational forces or applied pressure actuate the packer setting assembly and the disconnect assembly. The preliminary deliberate steps which must be taken also incorporate a feature of converting a gravel pack crossover assembly from the flow through mode to the crossover mode to facilitate the gravel placement. Circulation or reverse circulation to promote removal of debris upon insertion of the assembly without fear of actuation of the packer and disconnect assembly are also provided. A retention system to ensure the continuing functioning of the crossover assembly in the crossover mode is provided such that if differential forces on the sealing member are reduced to a very low value, the retaining mechanism acts to keep the sealing member against the seat to ensure continuing viability of operation of the crossover assembly during the placement of gravel. The unlocking is accomplished with a series of steps which involve reuse of an auxiliary sealing member in at least two positions in the wellbore.

32 Claims, 35 Drawing Sheets

FAILSAFE LINER INSTALLATION ASSEMBLY AND METHOD

FIELD OF THE INVENTION

The field of the invention relates to an apparatus and method for installation of oil field tubular goods such as well liners.

BACKGROUND OF THE INVENTION

In the past, subsequent to drilling the wellbore, a liner is frequently installed prior to the onset of regular production. Typically, a procedure commonly known in the industry as gravel packing is performed. An assembly composed of a work string, a running tool assembly, a disconnect assembly, a packer assembly, and a liner assembly, is put together at the surface and lowered into the wellbore. If a gravel pack procedure is contemplated, a gravel pack crossover assembly is installed, usually between the packer assembly and the liner assembly. In the past, after positioning the liner assembly at the desired location in the wellbore, the packer is set and the work string must be disconnected from the packer to be removed from the wellbore. Prior designs have involved disconnect assemblies that require rotation which allows a thread to disengage. Other mechanical connections that can be undone by rotation alone or in combination with a push or a pull have also been used in the past as the mode of disconnection between the disconnect assembly and the packer. Alternative designs have used pressure buildup which in turn creates a series of mechanical movements to facilitate disconnection between the disconnect assembly and the packer.

During routine operations with the liner systems described above, the entire assembly would be placed in the wellbore. The running tool would be actuated, thereby setting the packer. Thereafter, the disconnect assembly would be actuated to release the tubing string from the packer. At that time, if the particular operation called for it, a gravel pack procedure would be done. At the conclusion of a gravel pack procedure, the running tool assembly and the internal sections of the gravel pack crossover assembly are withdrawn, leaving the packer and liner assembly in the wellbore.

The prior systems for liner installation suffered from several drawbacks. One important drawback is a limited ability to rotate. The reason is that rotation could result in premature actuation of the disconnect assembly or setting the packer. Sometimes rotation is required, such as if the assembly is stuck in the wellbore. In those situations, experience has shown that many times the assembly can be unstuck if there is a capability to rotate. Previous designs have used shear pins to prevent premature actuation of the disconnect assembly. However, shear pins have a predetermined ability to resist shear forces up to the failure point. Sometimes forces larger than the capacity of the shear pins are required to liberate the assembly from a stuck position. As wellbores get more and more deviated or if they contain doglegs, the probability of sticking the assembly is increased. What has been lacking is a locking mechanism which ensures that the disconnect assembly will not be actuated upon the application of rotational force which may at times be necessary to further advance the assembly if it becomes stuck.

Another drawback of prior designs that actuate or disconnect hydraulically is that there are occasions, when running in the liner assembly, that the debris in the wellbore accumulates within the central flowpath or outside of the assembly. Experience has shown that to remove such accumulated debris within the central bore or on the outside of the assembly, pressure can be applied from the surface, either through the annulus or through the central bore, to circulate or reverse circulate this debris out of the wellbore. The debris needs to be removed so that subsequent procedures can take place. Unfortunately, if the assembly is hydraulically actuated, pressure buildup in trying to move accumulated debris, either within the central bore or in the annulus, can create sufficient forces to cause premature actuation of the running tool assembly and/or premature actuation of the disconnect assembly. Accordingly, what is needed is a tool and method of the present invention which prevents actuation, regardless of the amount of pressure buildup. This is done by constructing the apparatus in such a manner that deliberate steps must be taken at the surface in order for the pressure applied for debris removal to actuate either the running tool assembly, i.e., the packer, or the disconnect assembly adjacent the packer. One of several ways to do this is to provide a pressure-balanced tool assembly which accordingly cannot be actuated until a pressure-type plug device or other device is inserted into the assembly. Similarly, the disconnect assembly can be locked positively, using mechanical or hydraulic mechanisms which will not actuate on pressure buildup until several preliminary steps are deliberately taken. Without these preliminary steps, any application of pressure in the apparatus or outside of it will not actuate the setting assembly for the packer or the disconnect assembly adjacent the packer.

It should be noted that prior designs suffered from the problem of inadvertent actuation, regardless of whether the applied pressure was in the annulus or in the central flowpath. Some prior designs were set up to actuate on increasing annulus pressure.

Another drawback of the prior art has been that when using a gravel pack crossover assembly, circulation was not possible to the bottom of the liner assembly because the presence of the crossover assembly provided a path of least resistance immediately downhole from the packer assembly. The apparatus and method of the present invention provide a convertible gravel pack crossover assembly. The apparatus and method have been developed such that the necessary preliminary steps of defeating the various locks and setting the packer have incorporated a feature of converting the crossover sub into the crossover mode. Additional features have been added such that the mechanism which accomplishes this conversion from straight through to the crossover mode is physically retained in a sealing relationship against the circulation forces which act on it, which would in some instances tend to make the mechanism come away from the sealing surface. Accordingly, the apparatus and method have included a retaining feature for the sealing member which accomplishes the conversion to crossover flow. The apparatus and method of the present invention have the flexibility to allow circulation or reverse circulation to remove debris and changeover of a convertible gravel pack crossover assembly to permit deposition of the gravel outside the liner and a return flow through the crossover member out the annulus onto the surface.

One of the objects of this invention is to allow security for the operator to know that application of twisting forces or hydraulic pressure within the liner assembly or in the annulus outside will not inadvertently actuate the release mechanism or set the packer prematurely.

SUMMARY OF THE INVENTION

An apparatus and method for installation of oil field tubulars, such as liners, is disclosed. The invention allows positioning of a liner with assurances that rotational forces or pressure applied within or outside the work string will not actuate the packer or the release assembly above the packer. Specific deliberate steps must be taken in order that rotational forces or applied pressure actuate the packer setting assembly and the disconnect assembly. The preliminary deliberate steps which must be taken also incorporate a feature of converting a gravel pack crossover assembly from the flow-through mode to the crossover mode to facilitate the gravel placement. Circulation or reverse circulation to promote removal of debris upon insertion of the assembly without fear of actuation of the packer and disconnect assembly are also provided. A retention system to ensure the continuing functioning of the crossover assembly in the crossover mode is provided such that if differential forces on the sealing member are reduced to a very low value, the retaining mechanism acts to keep the sealing member against the seat to ensure continuing viability of operation of the crossover assembly during the placement of gravel. The unlocking is accomplished with a series of steps which involve reuse of an auxiliary sealing member in at least two positions in the wellbore.

In an alternative embodiment, the seat assembly for the first seat for the ball dropped to initiate movement is presented. The alternative design allows release of the ball from the seat with lower differential pressures. In the alternative embodiment, the action which operates to set the packer also unlocks the hydraulic release mechanism, thus enabling it to function. In a situation where the ball fails to seat on the lower-most seat, the rotational release is operational.

DETAIL DESCRIPTION OF THE DRAWINGS

FIGS. 8A–D illustrate an alternative embodiment of the apparatus of the present invention in the run-in position.

FIGS. 9A–D is the apparatus shown in FIG. 8 in the position after the ball is dropped and the tubing is pressurized to set the packer.

FIGS. 10A–D is the apparatus of FIG. 8 after the annulus is pressured to test the packer.

FIGS. 11A–D is the apparatus of FIG. 8 after the tubing is pressurized to shift the ball from the first to the second seat.

FIGS. 12A–D is the apparatus of FIG. 8 after the annulus is pressurized to actuate the hydraulic release mechanism.

Figure 13:
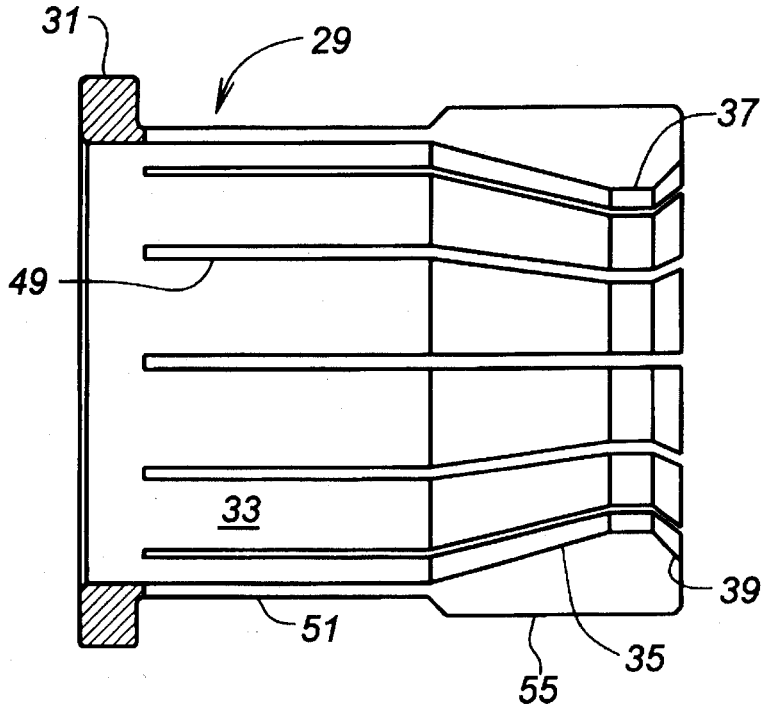

FIG. 13 is a detail view of the exterior support for the first seat for the ball.

Figure 14:
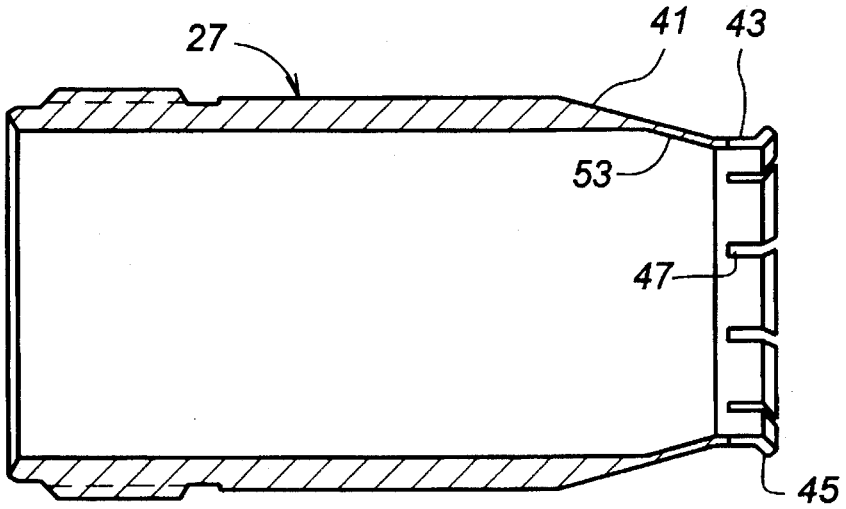

FIG. 14 is the seat member for the first seat for the ball.

DETAILED DESCRIPTION OF THE PREFERRED EMBODIMENT

Figure 1A:
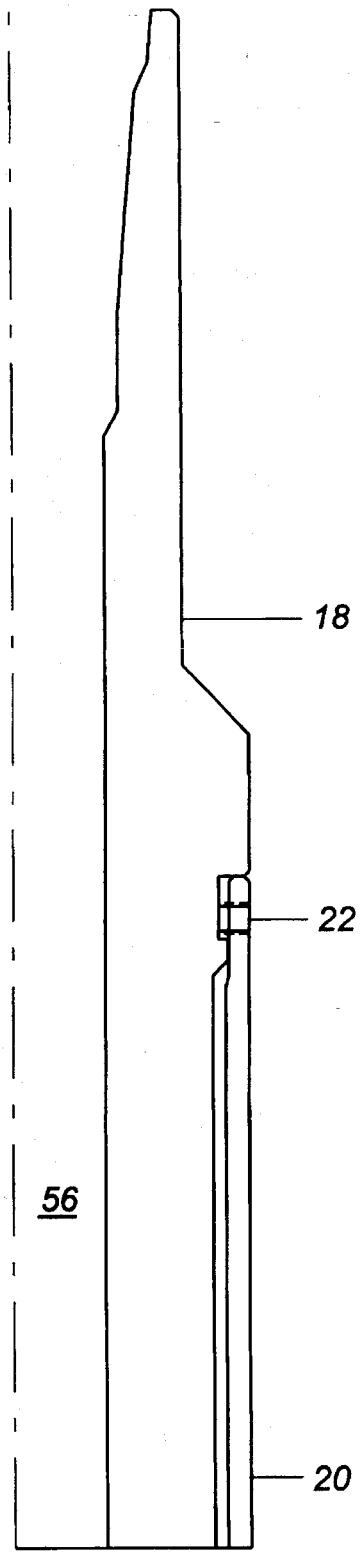
FIG. 1 is an elevational part section view of the running tool disconnect and packer assembly of the present invention in the run-in position.
Figure 2A:
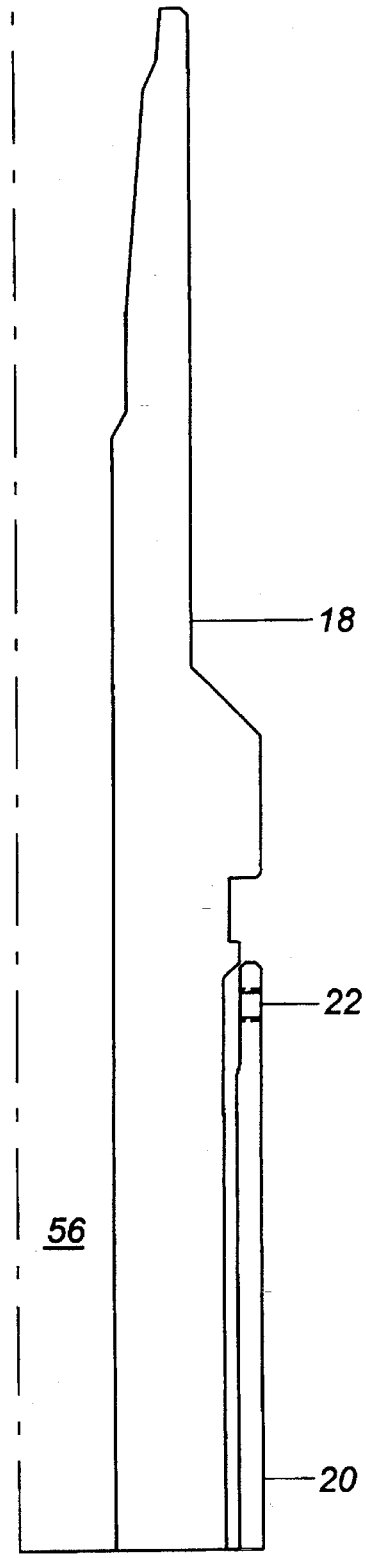
FIG. 2 is the view of FIG. 1, with the apparatus in the beginning setting position.
Figure 1B:
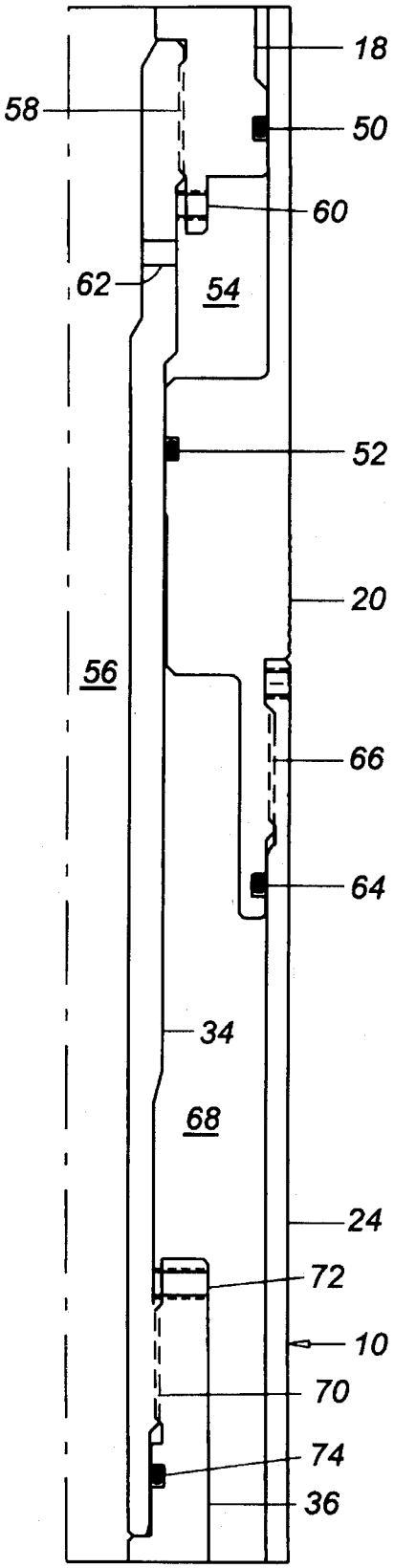
Figure 2B:
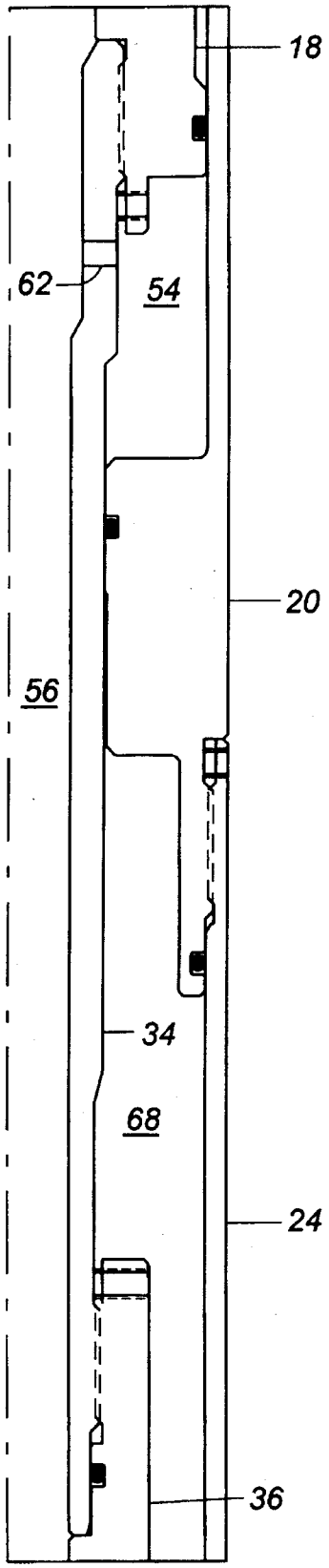
Figure 1C:
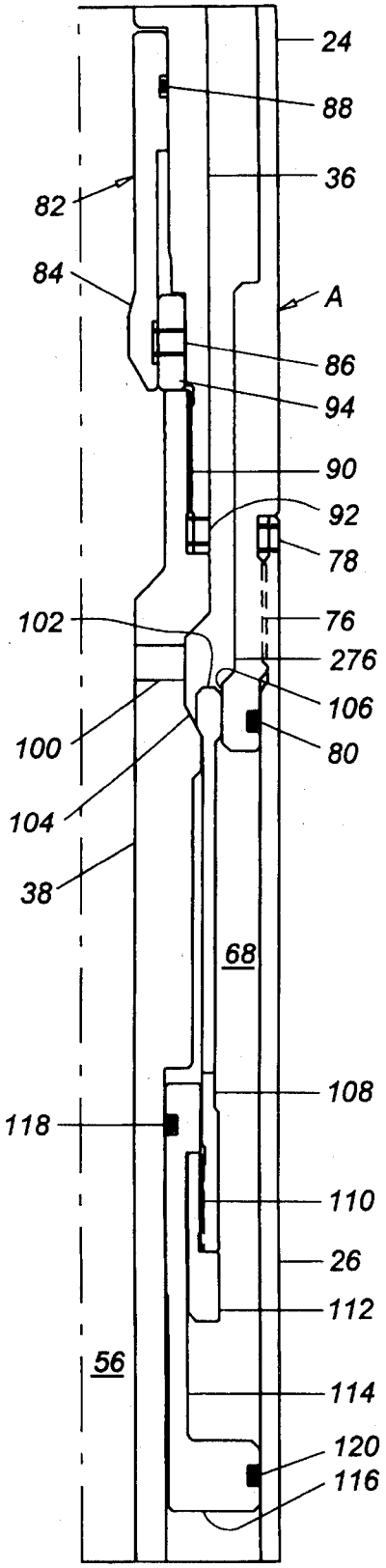
Figure 2C:
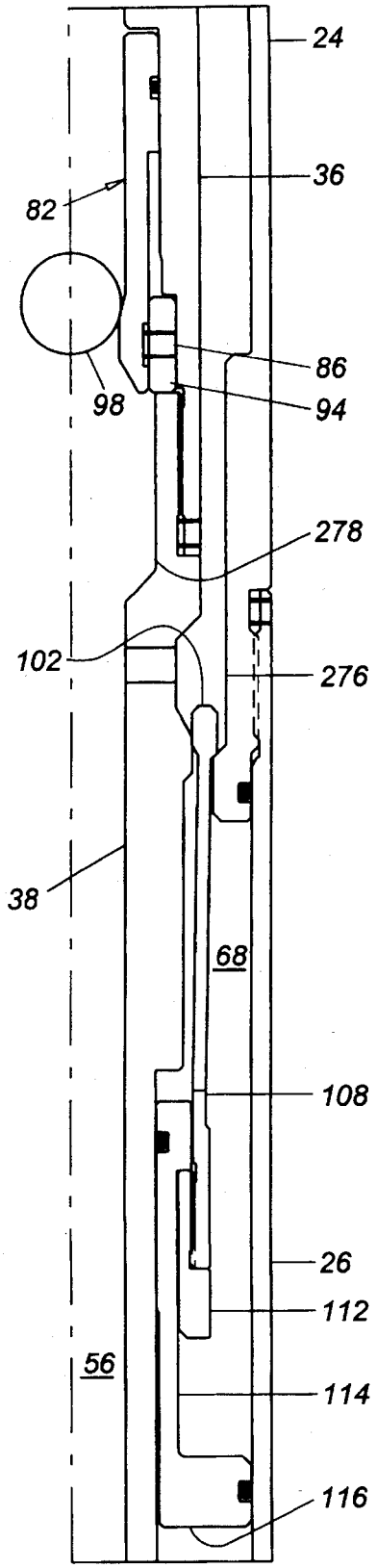
Figure 1D:
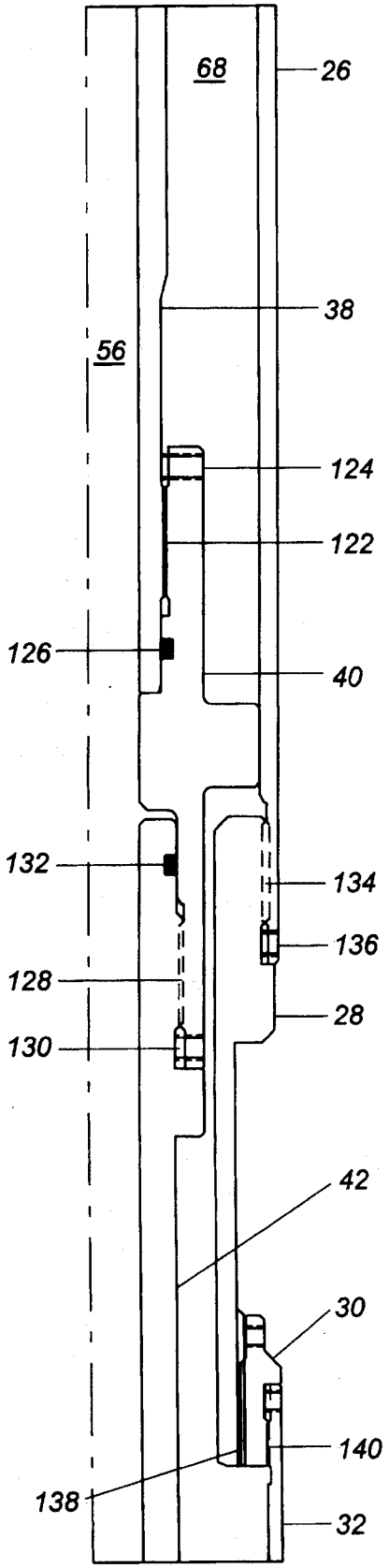
Figure 2D:
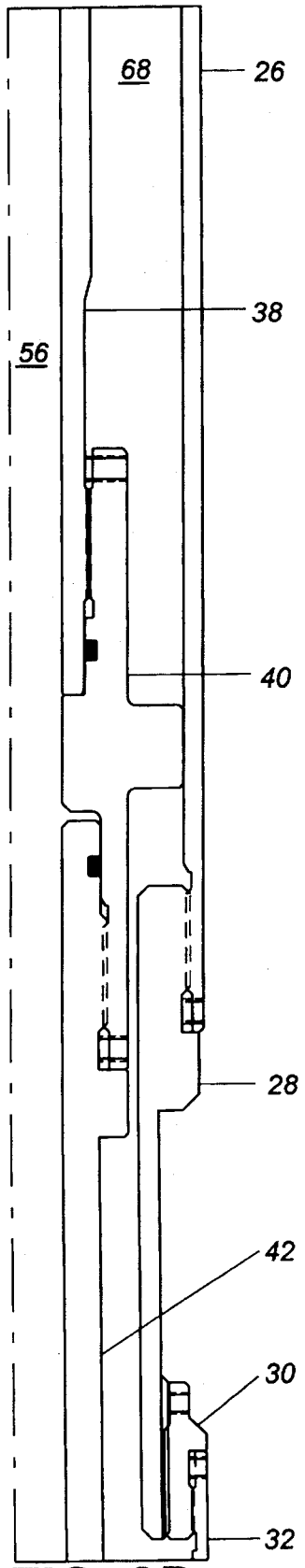
Figure 1E:
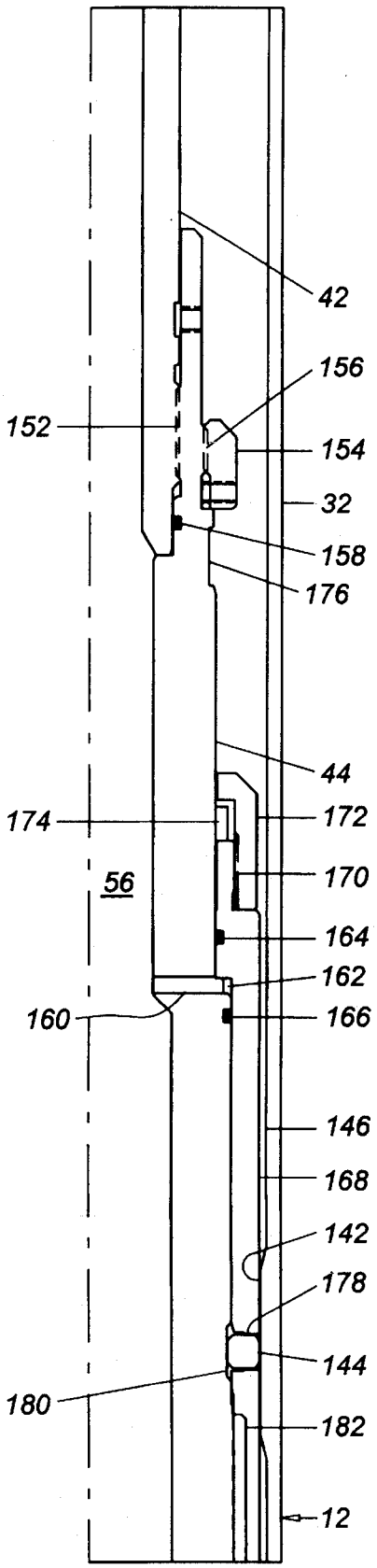
Figure 2E:
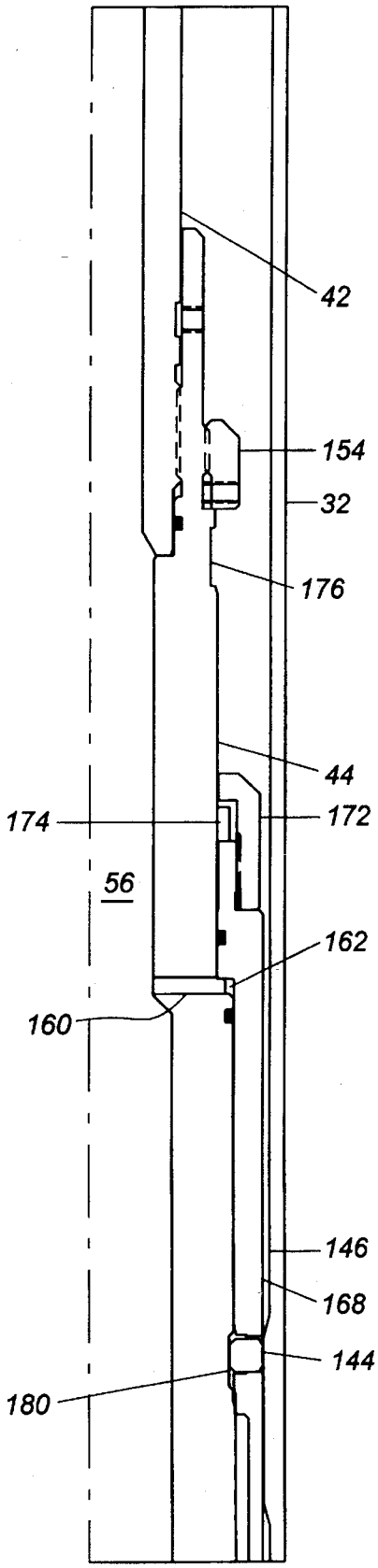
Figure 1F:
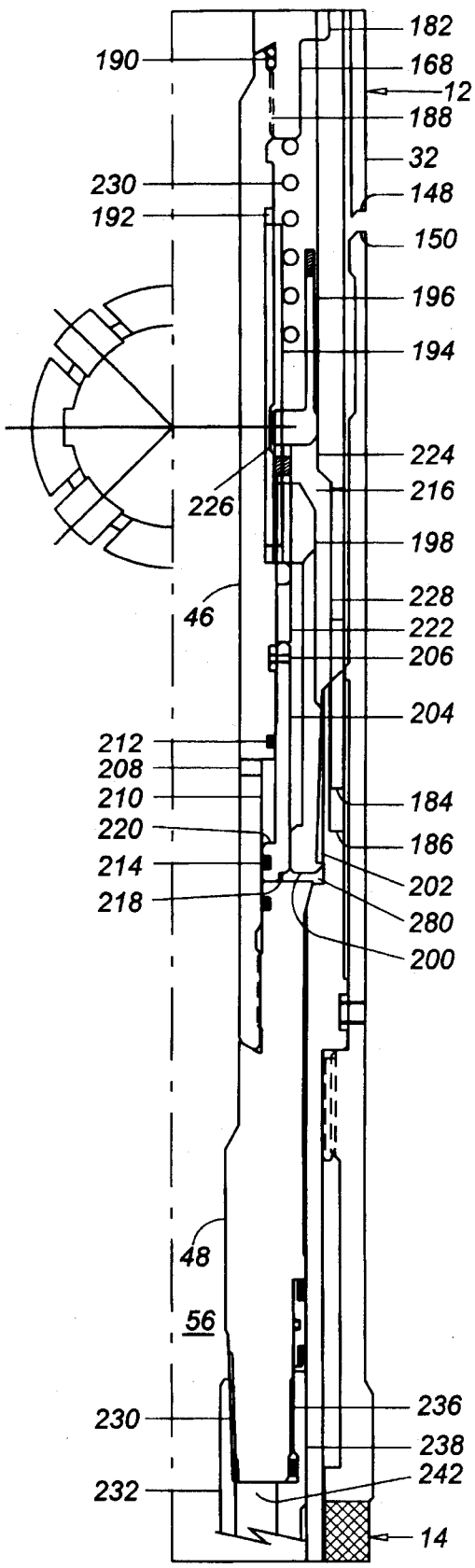
Figure 2F:
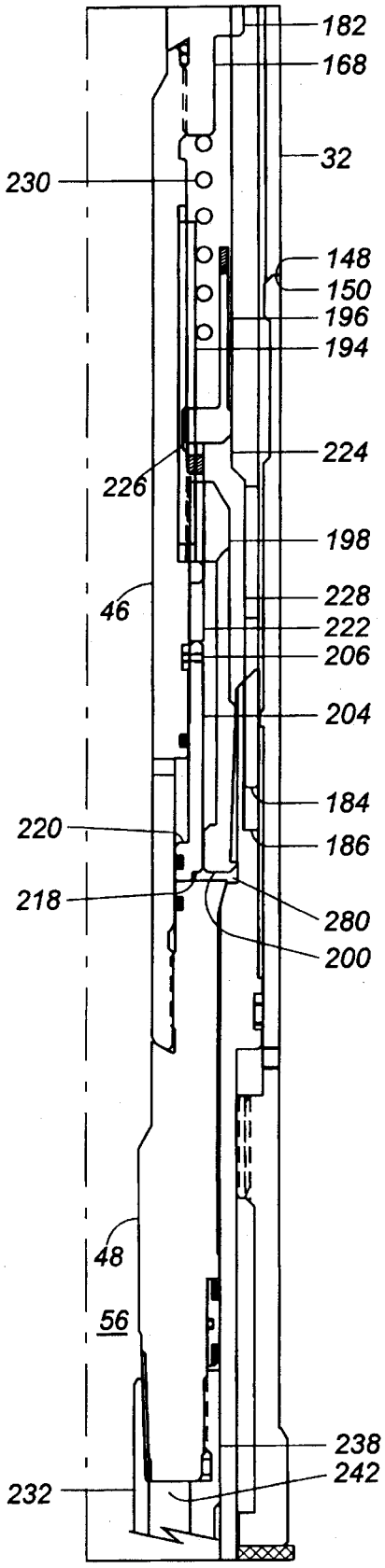
Figure 1G:
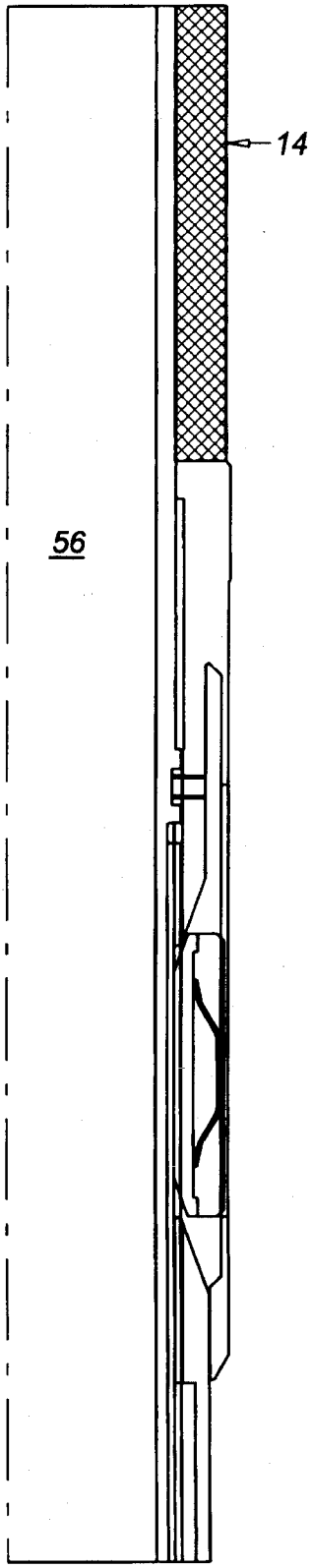
Figure 2G:
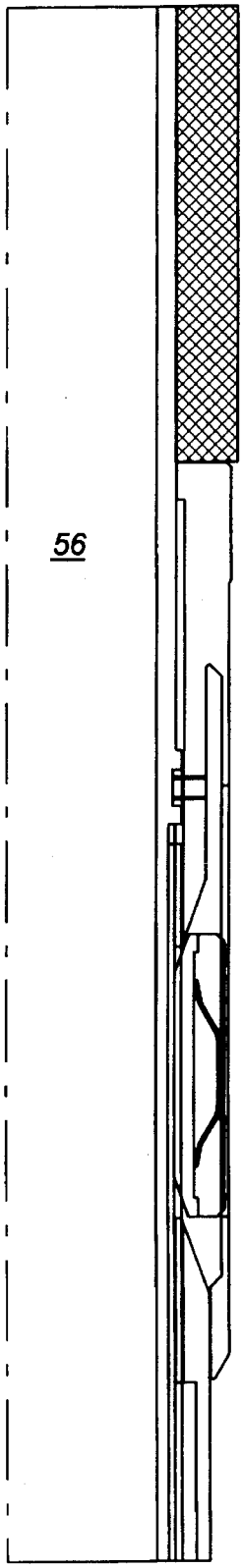
Figure 1H:
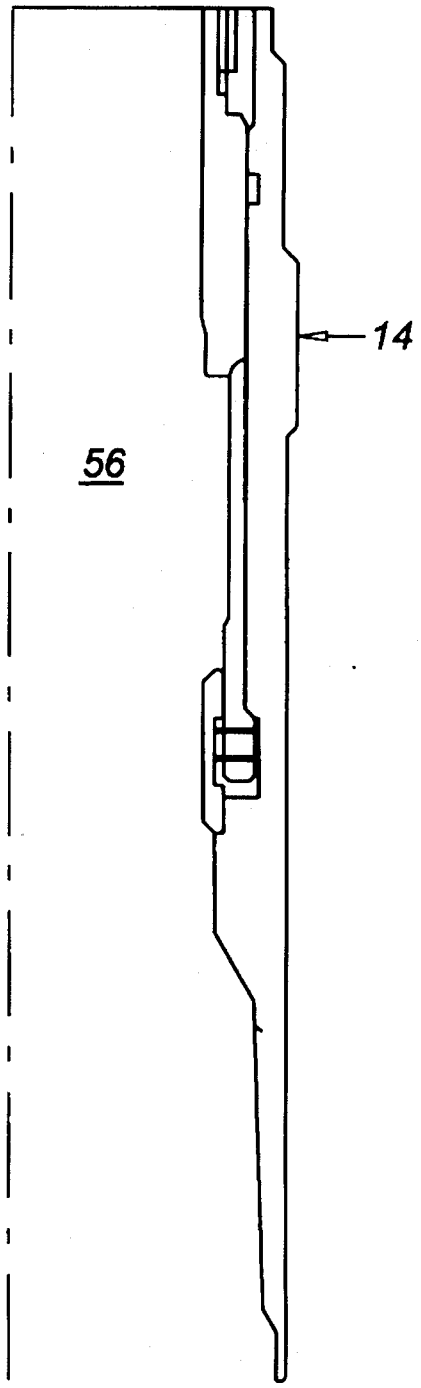
Figure 2H:
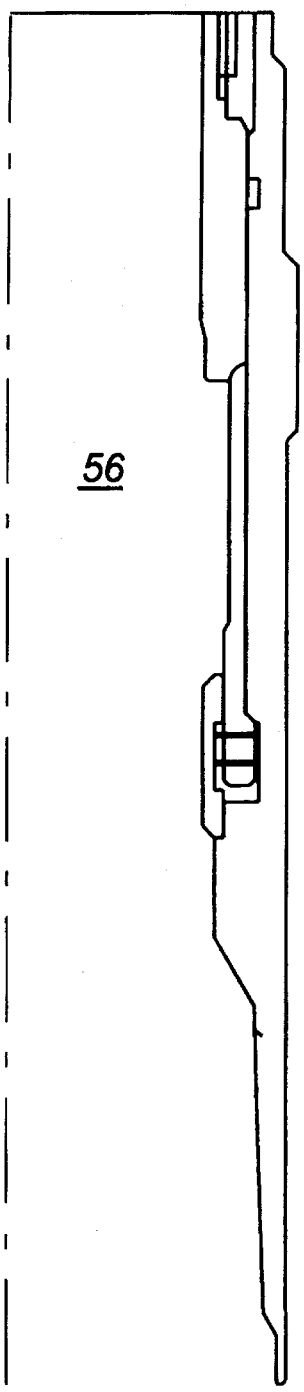
Figure 3A:
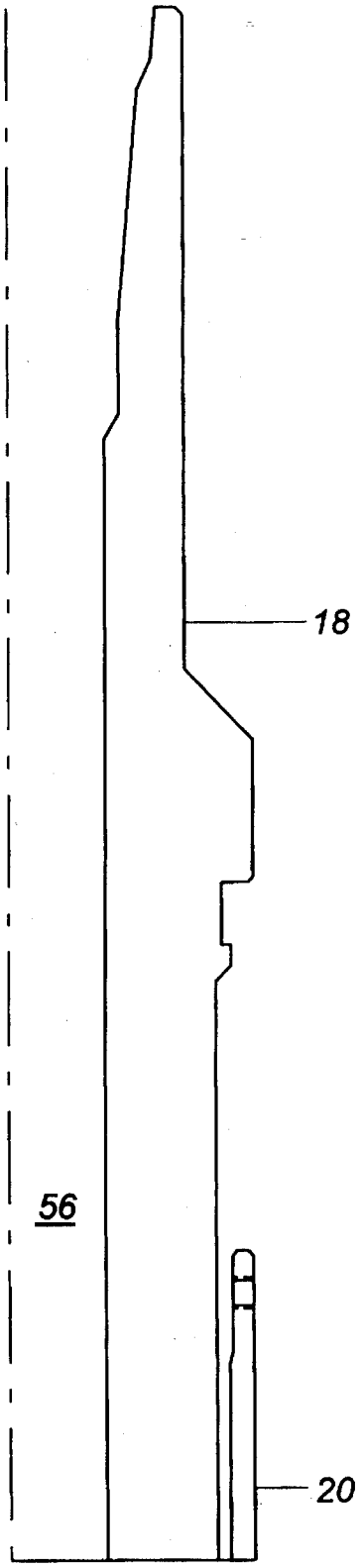
FIG. 3 is the view of FIG. 2 with the packer set, the seat sheared, and the rotational sleeve locked out.
Figure 4A:
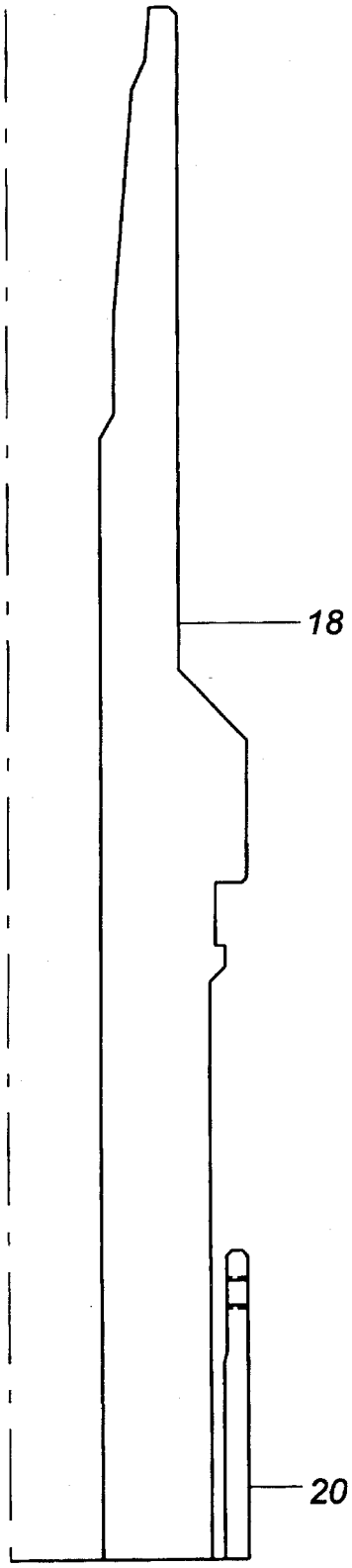
FIG. 4 is the view of FIG. 3, with the releasing sleeve shifted using annulus pressure.
Figure 3B:
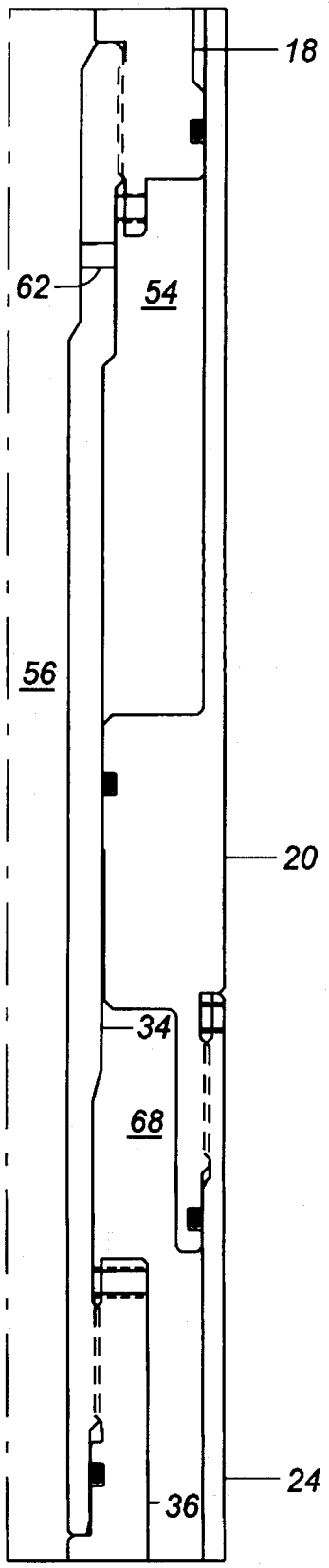
Figure 4B:
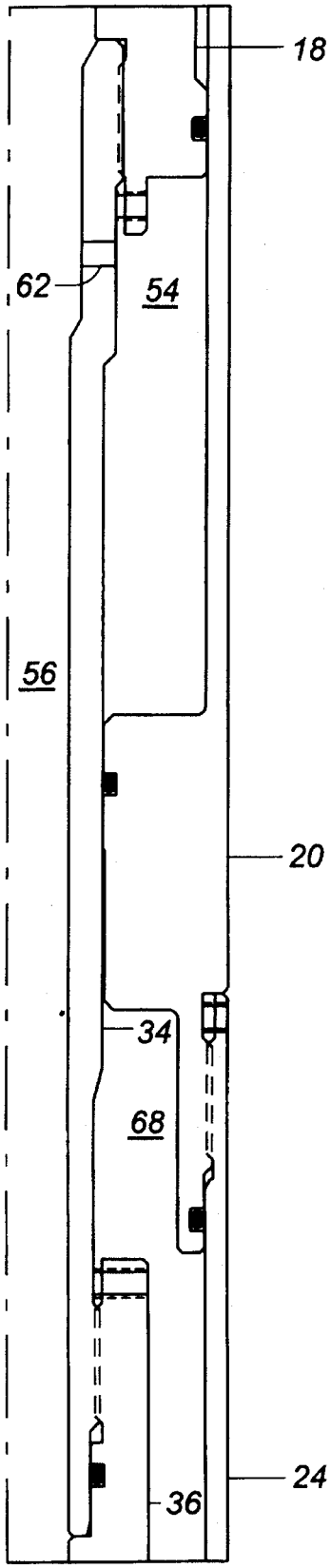
Figure 3C:
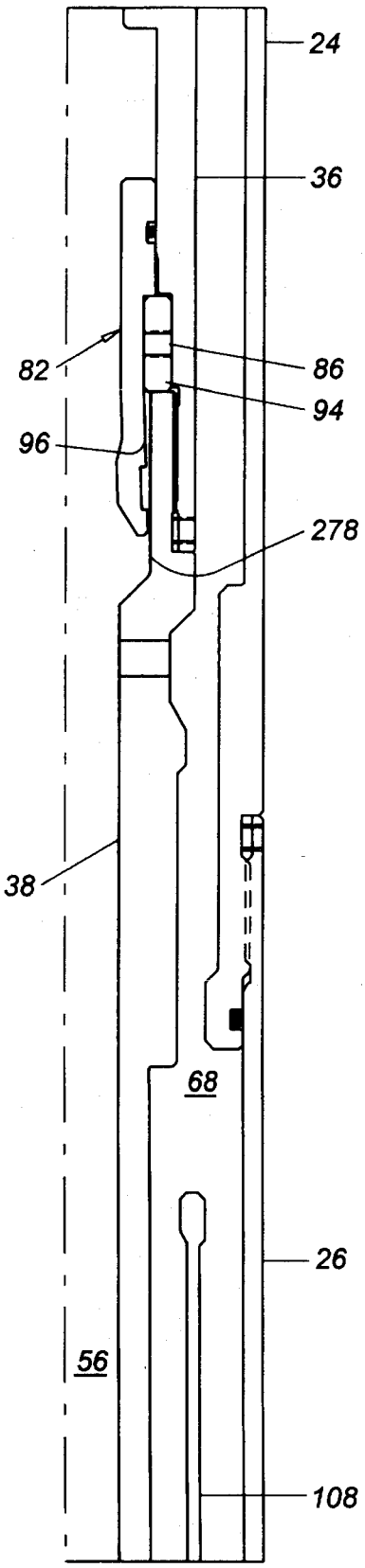
Figure 4C:
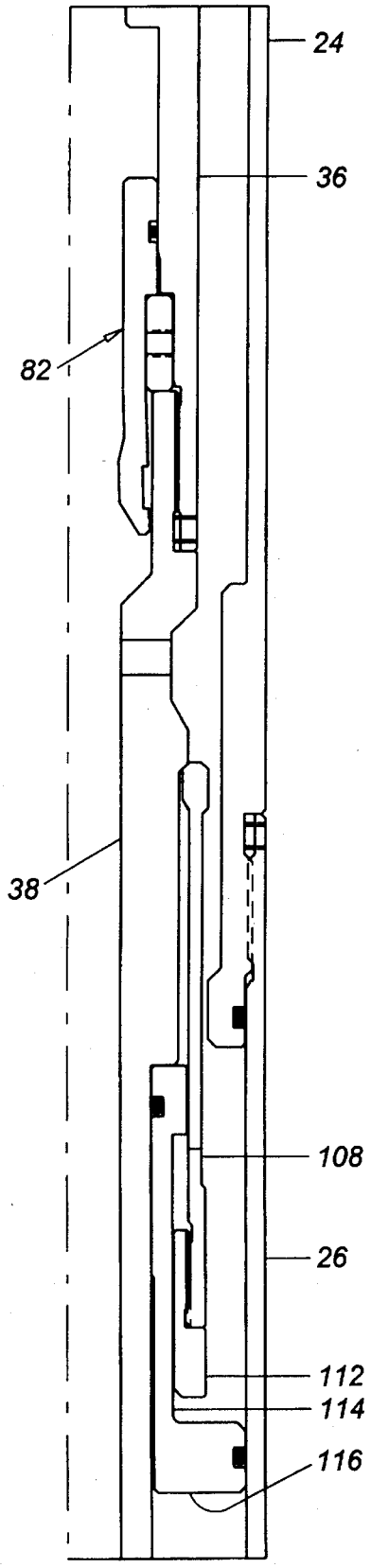
Figure 3D:
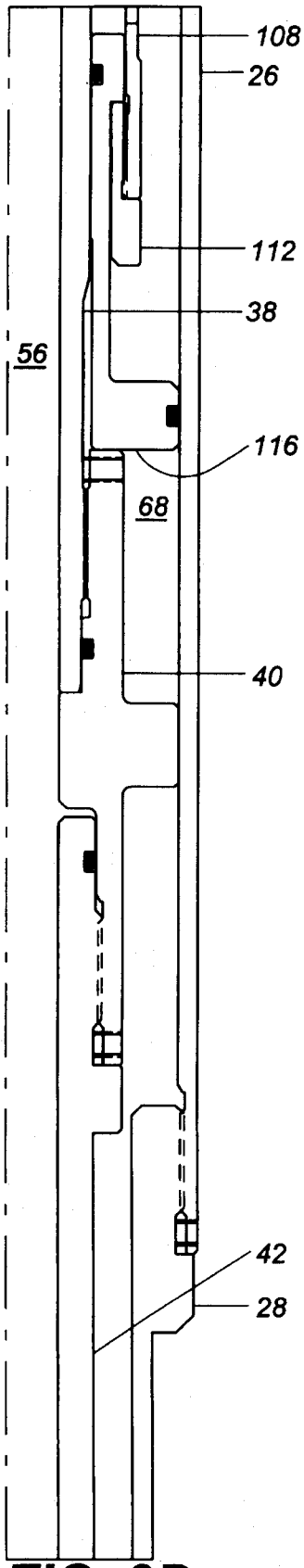
Figure 4D:
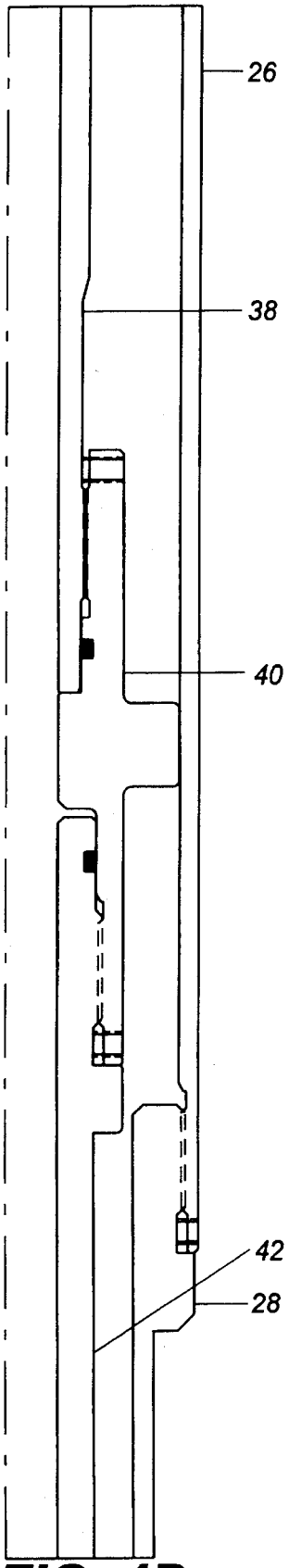
Figure 3E:
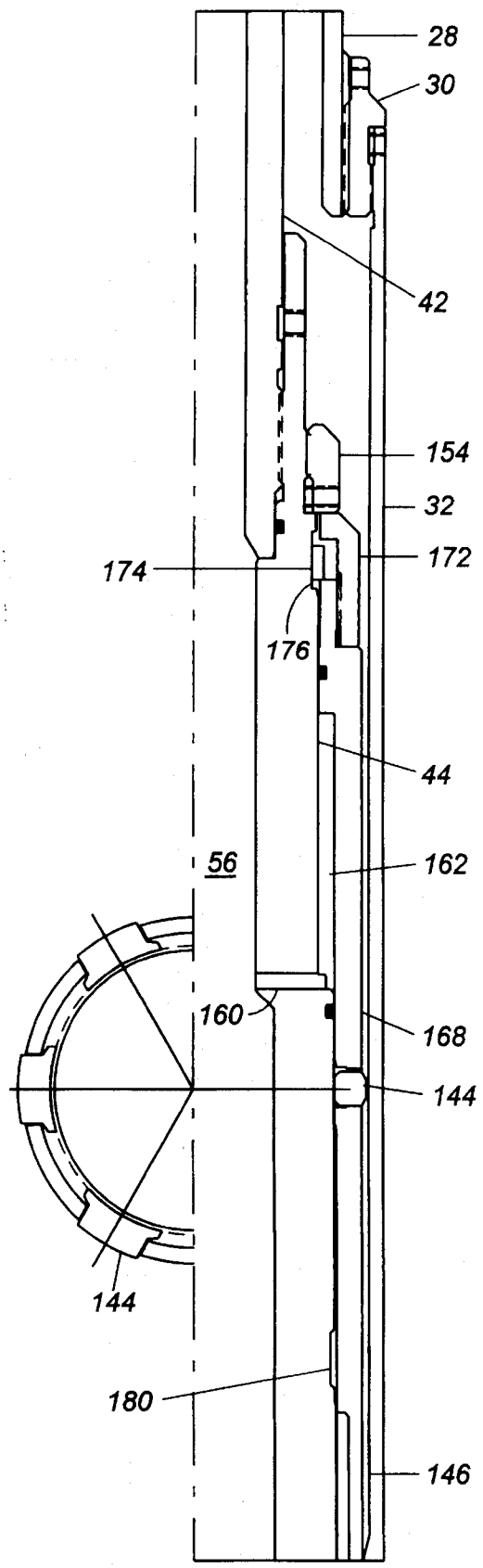
Figure 4E:
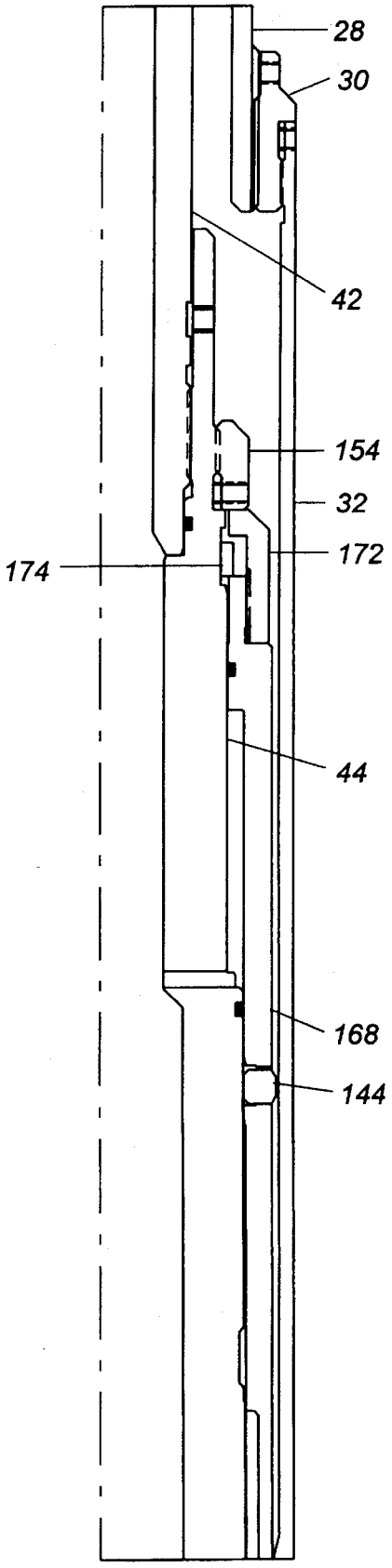
Figure 3F:
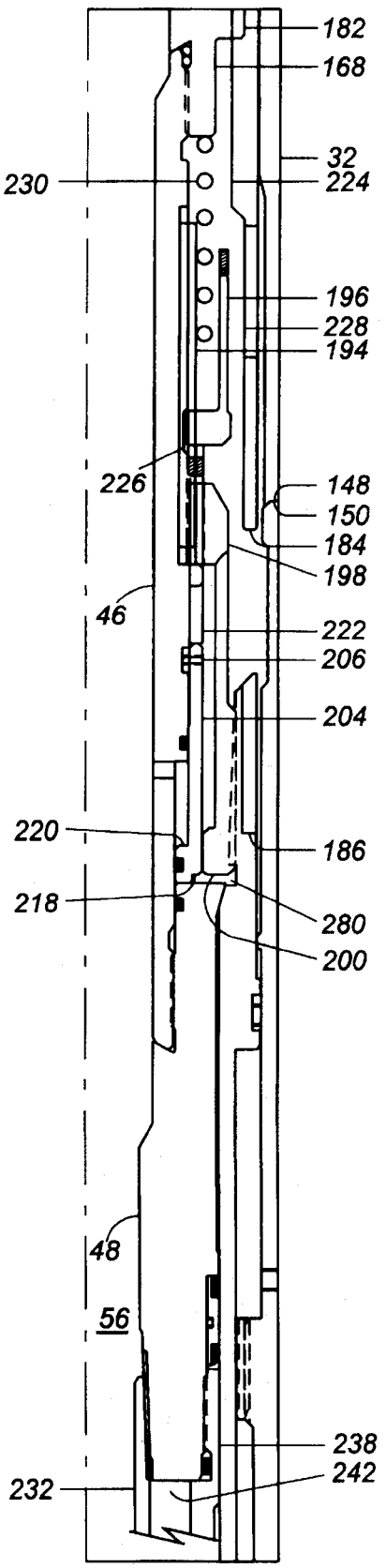
Figure 4F:
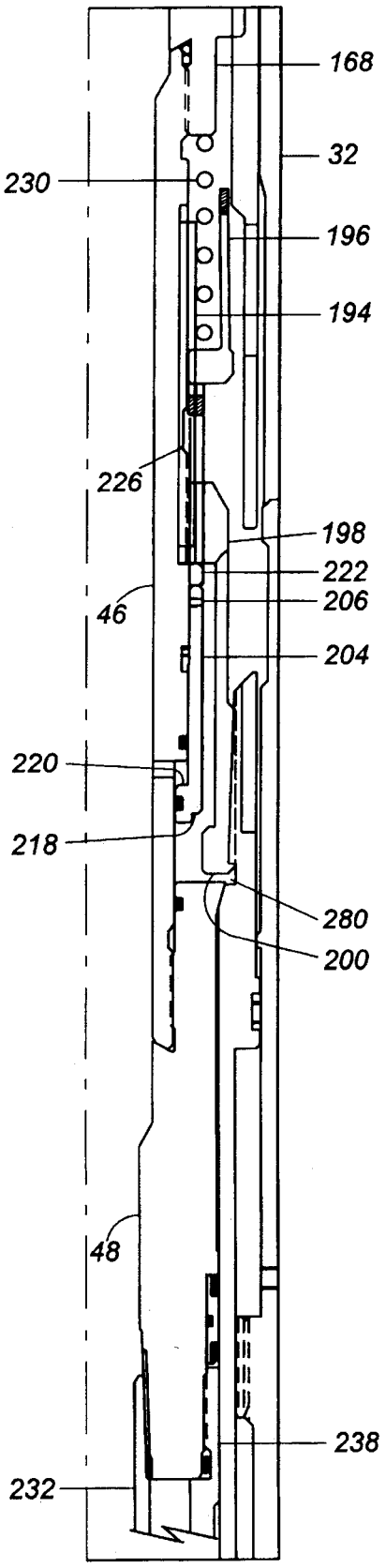
Figure 3G:
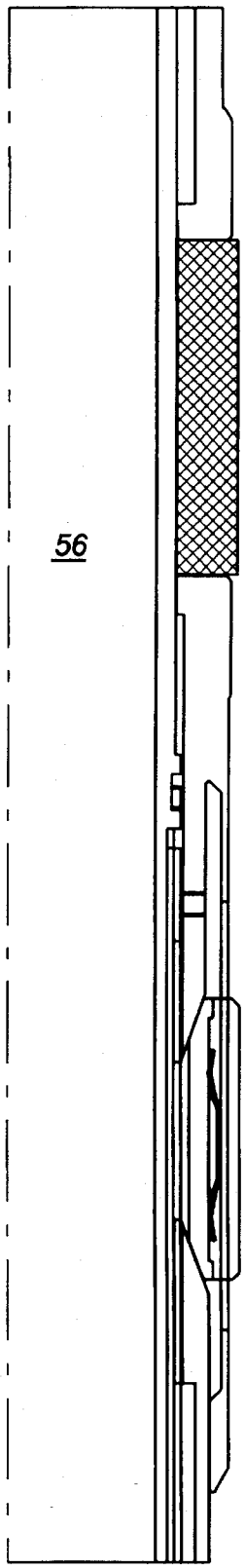
Figure 4G:
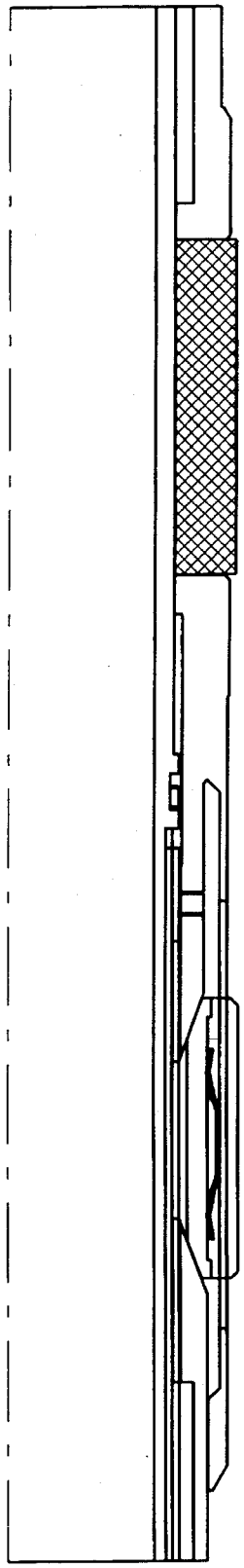
Figure 3H:
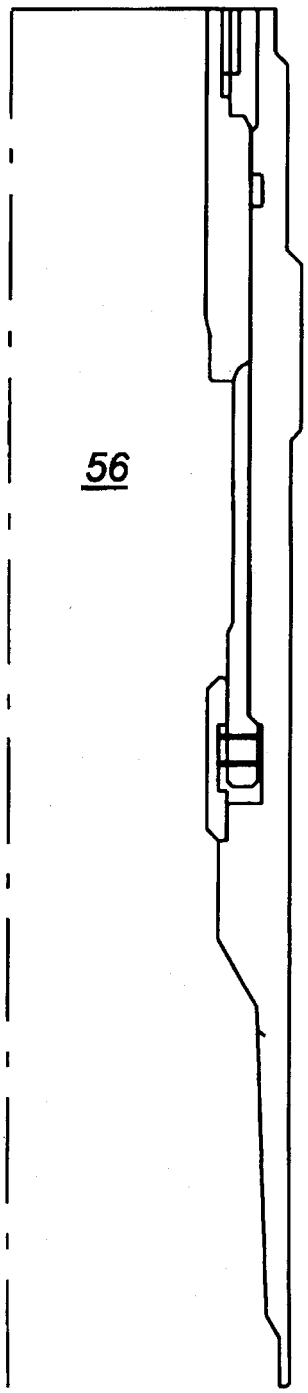
Figure 4H:
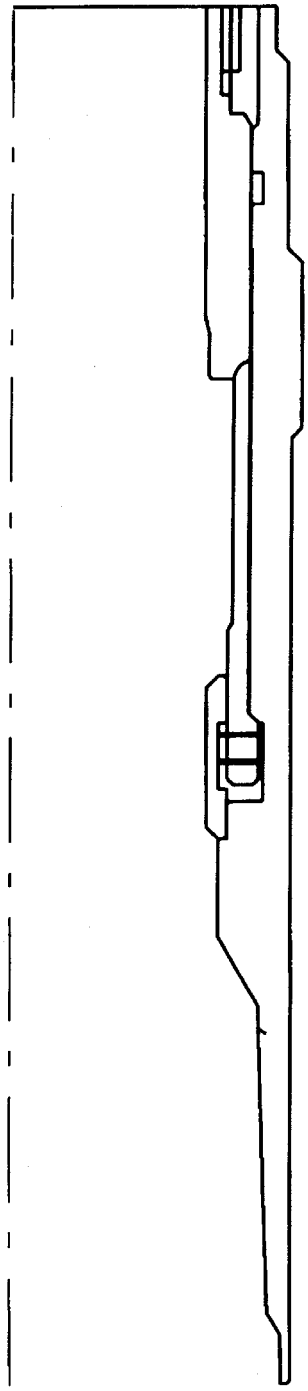
Figure 5A:
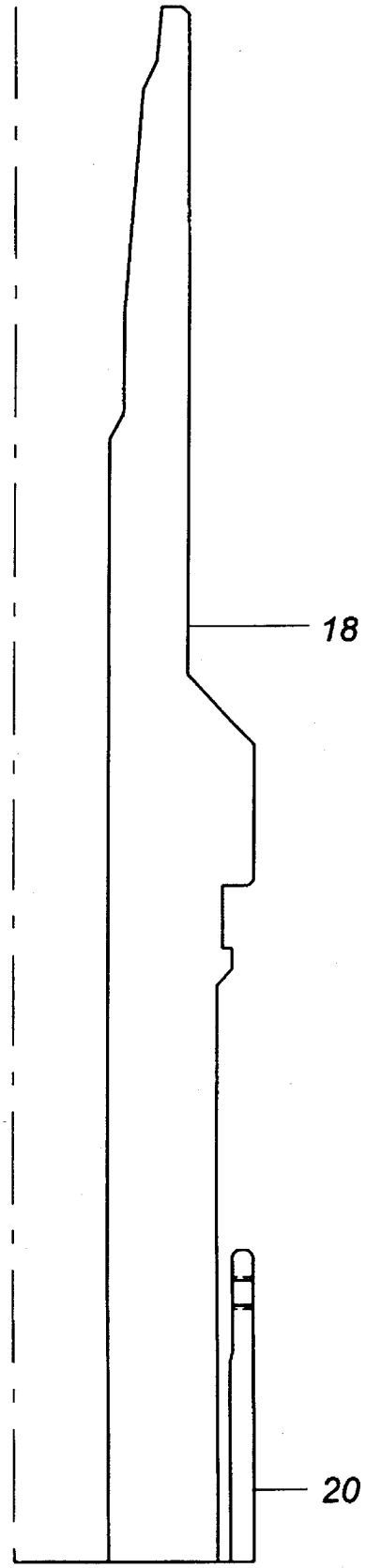
FIG. 5 is the view of FIG. 4, showing the apparatus in the set back down position used in doing a "squeeze" job.
Figure 5B:
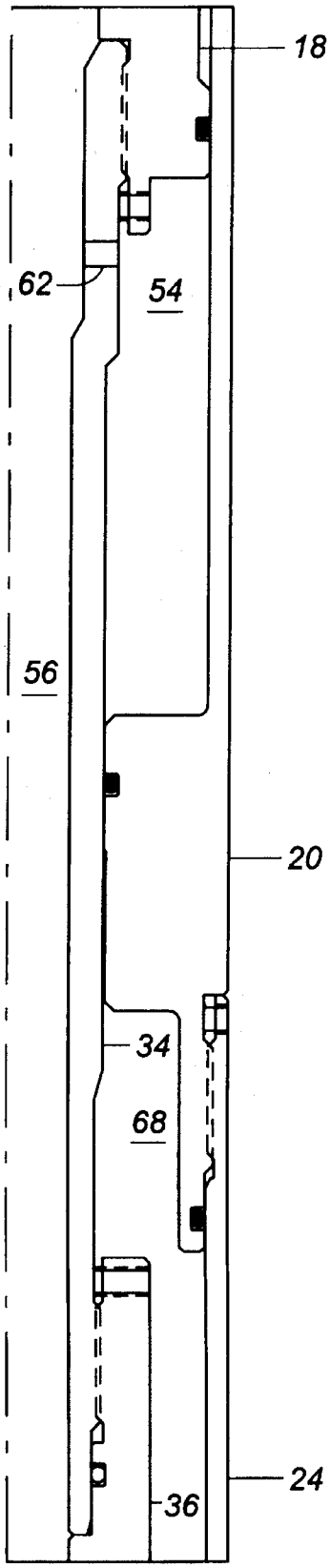
Figure 5C:
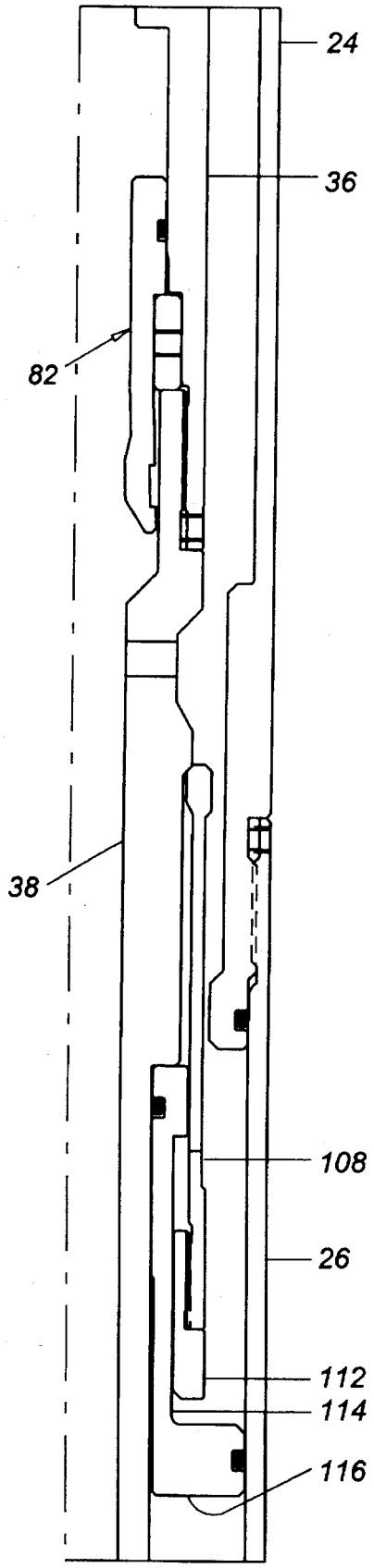
Figure 5D:
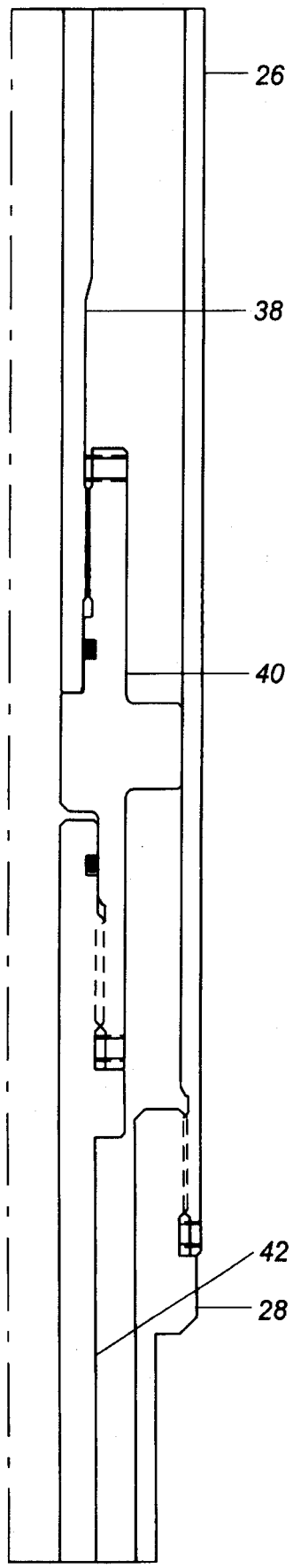
Figure 5E:
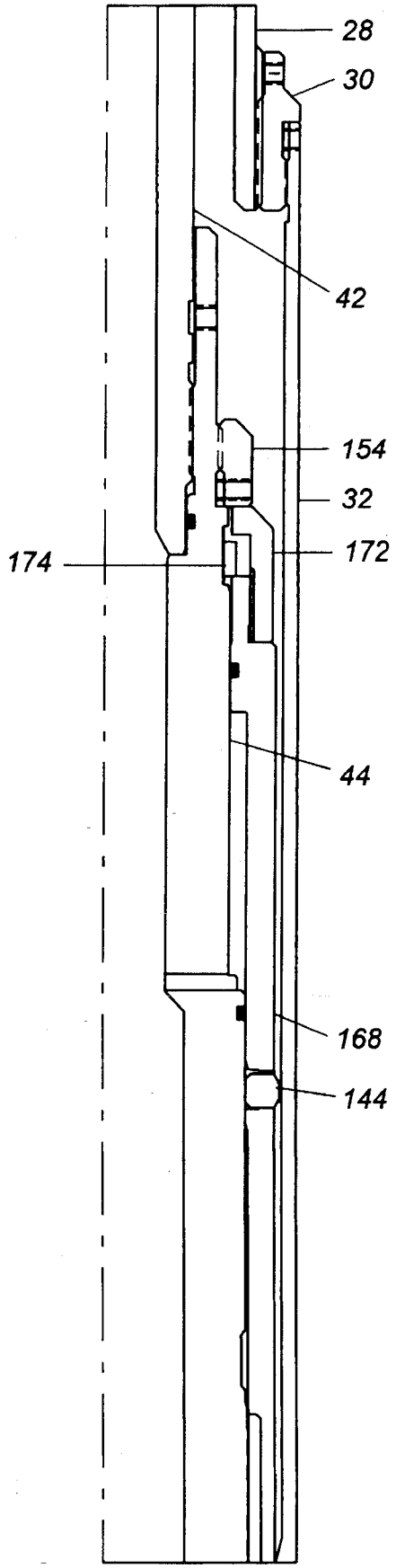
Figure 5F:
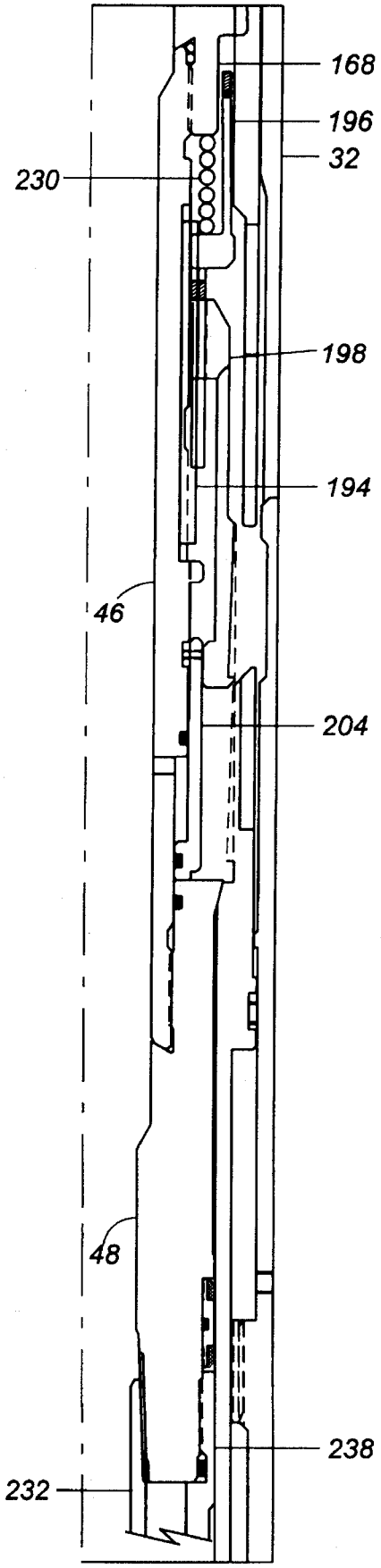
Figure 5G:
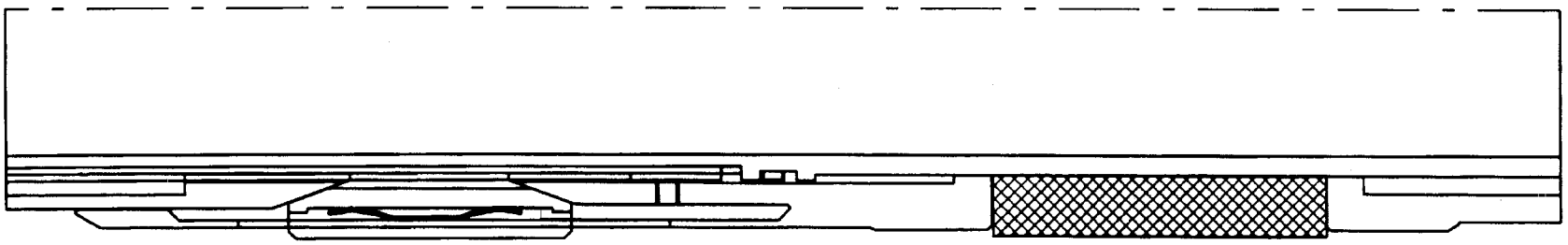
Figure 5H:
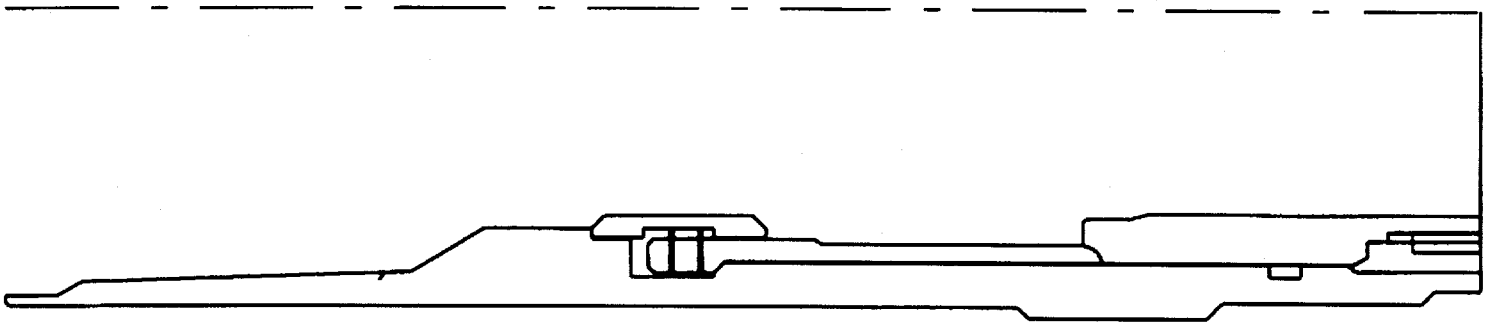
Figure 6A:
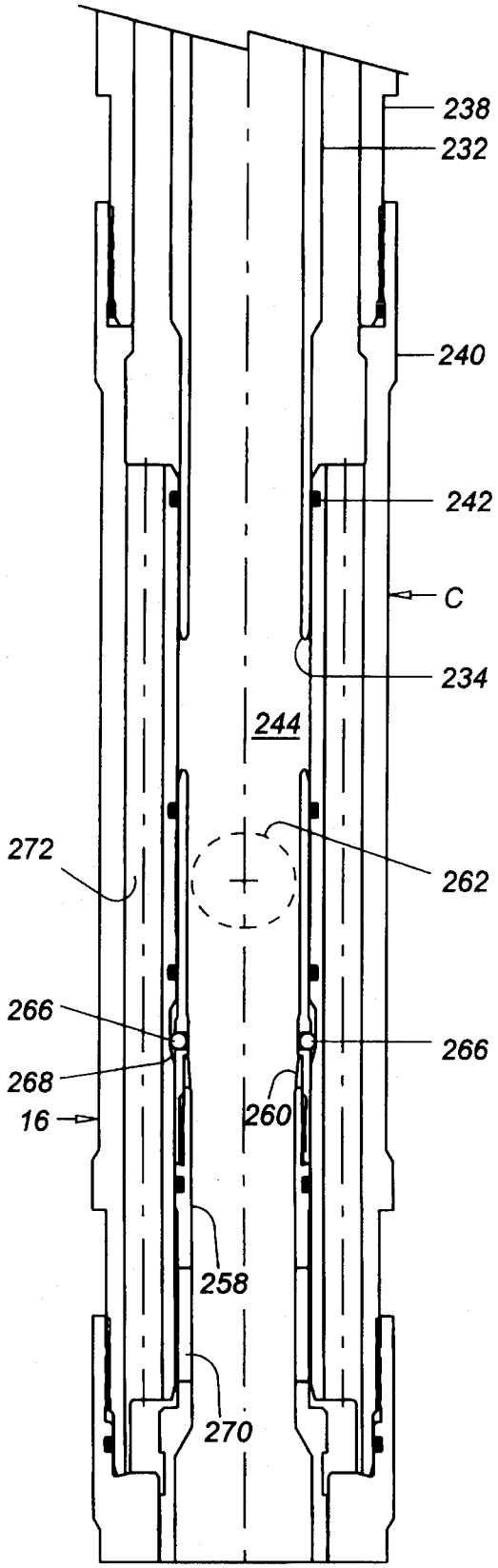
FIG. 6 is a sectional elevational view of the gravel pack crossover assembly in its initial position.
Figure 7A:
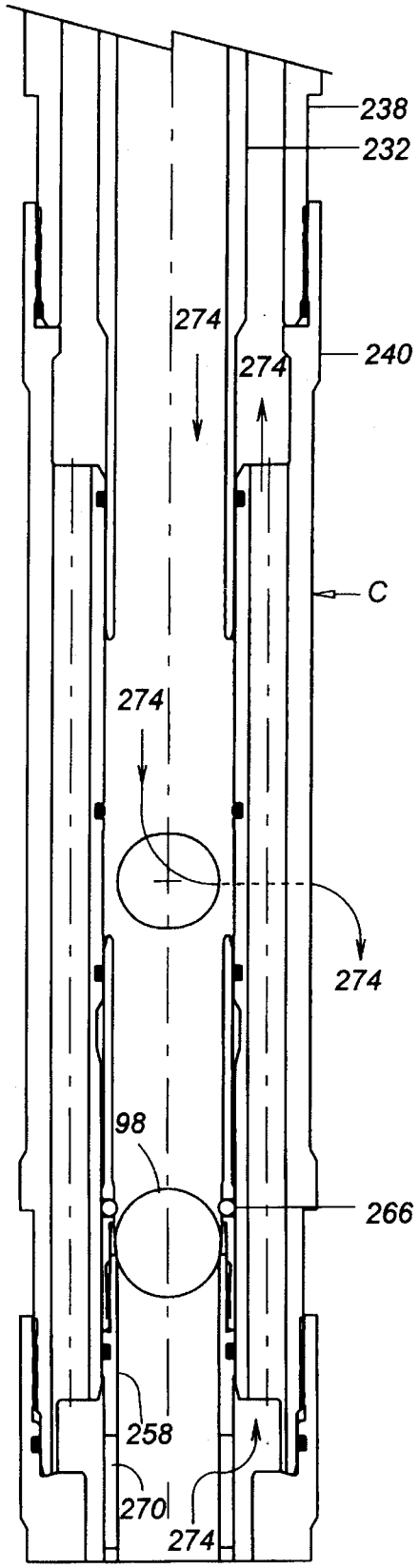
FIG. 7 shows the crossover assembly of FIG. 6 in the crossover mode.
Figure 6B:
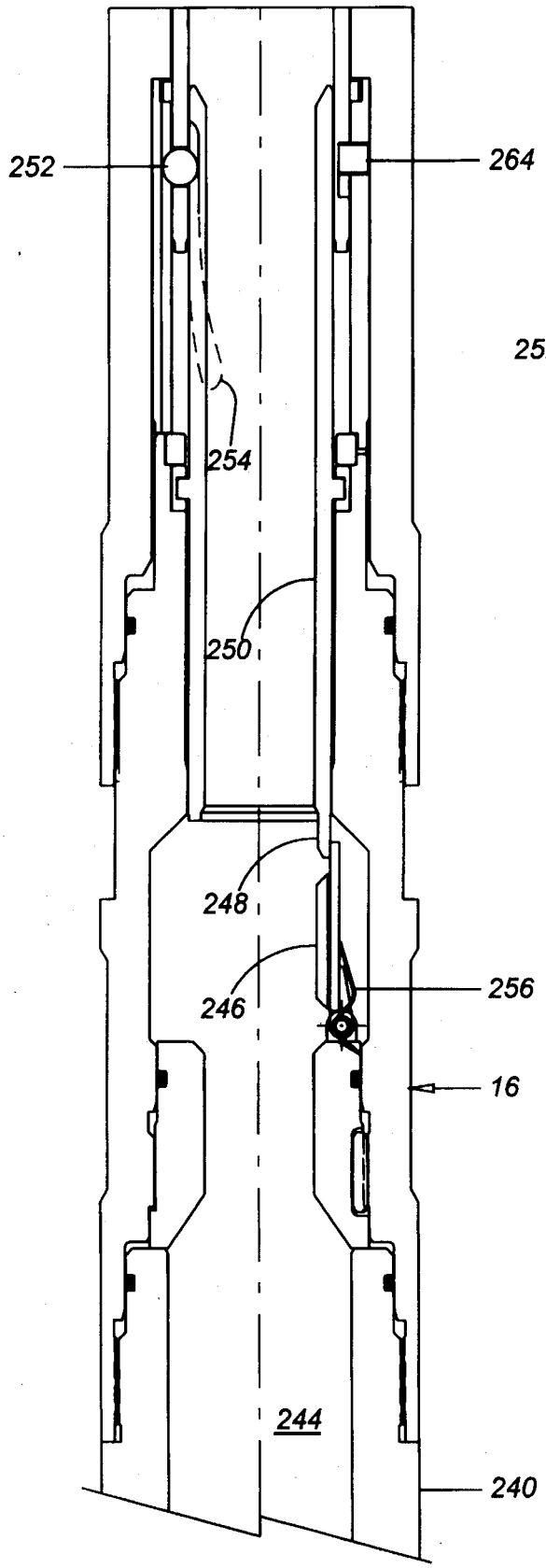
Figure 7B:
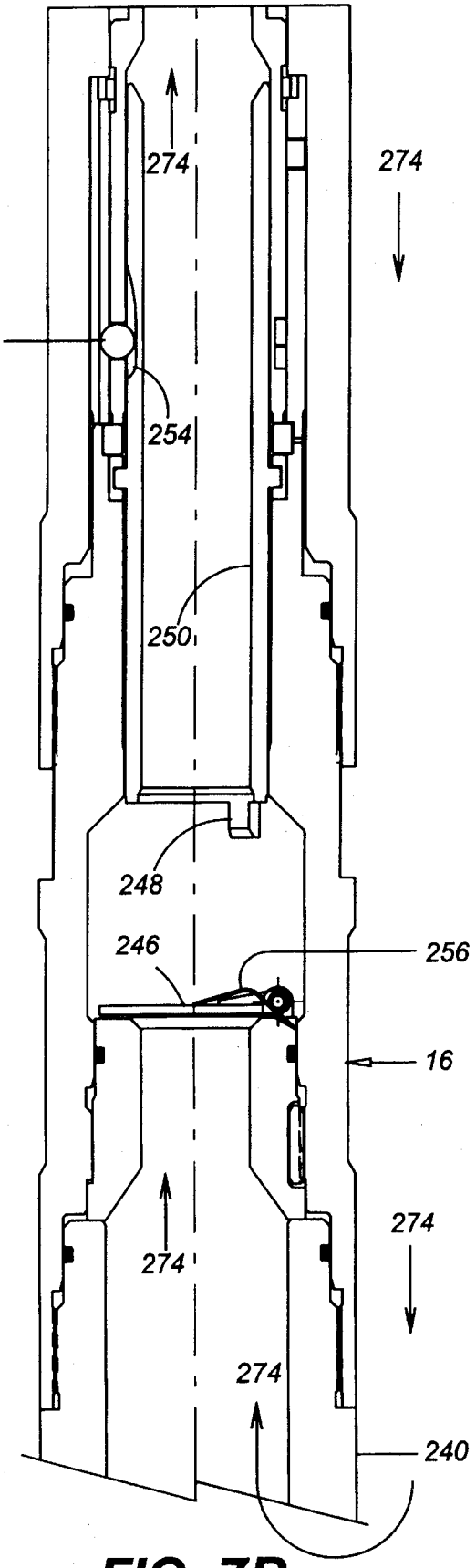
Figure 8A:
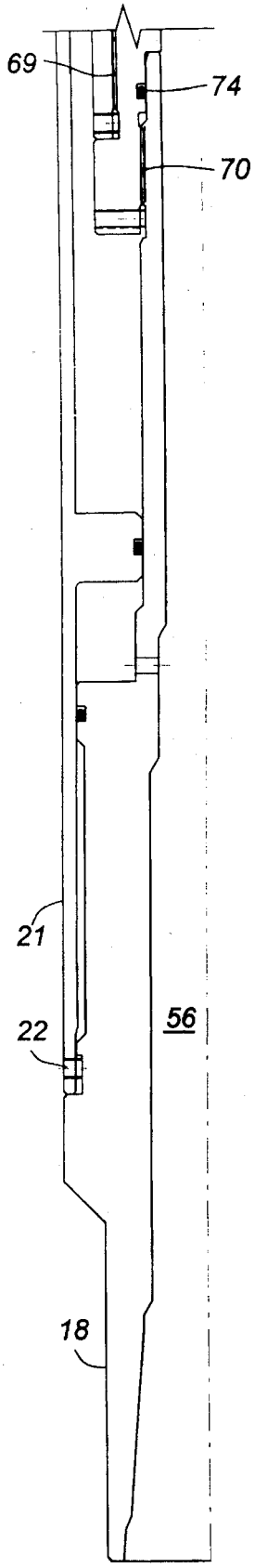
Figure 10A:
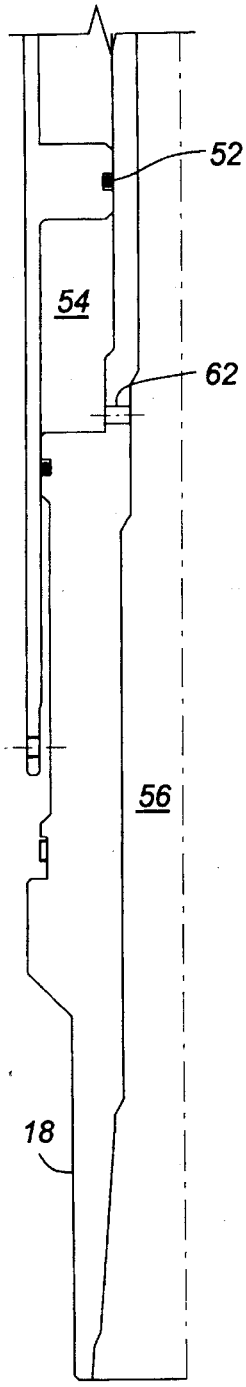
Figure 8B:
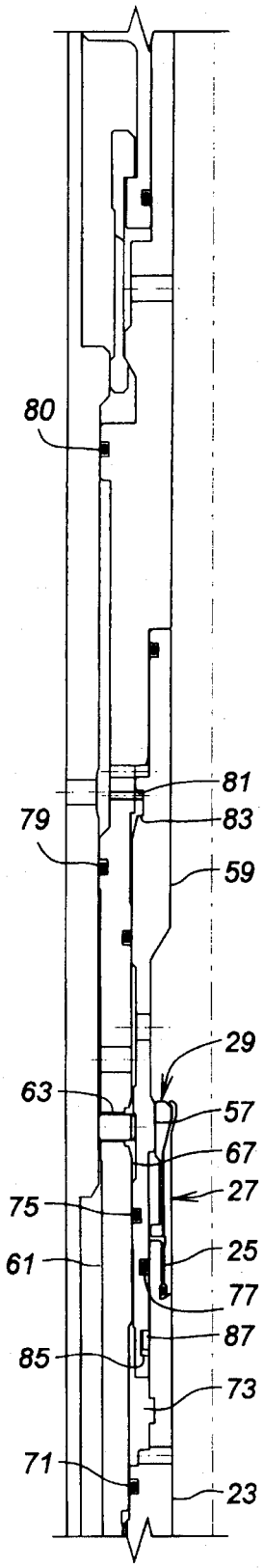

The apparatus A has an upper section 10 and a lower section 12. A packer assembly 14 is disposed adjacent lower section 12. The packer assembly 14 is of a substantially known design and does not form a part of the apparatus A of the present invention. Mounted below the packer assembly 14 is a crossover tool 16, as shown in FIGS. 6 and 7.

The upper section 10 comprises a top sub 18, as shown in FIG. 1. A pressure-balanced piston 20 is initially connected to the top sub 18 by virtue of shear pin 22. The work string (not shown) is mounted to the top sub 18 in the customary manner. Connected to the pressure-balanced piston 20 in series are upper housing 24, housing 26, piston extension 28, adjustment ring 30, and adapter sleeve 32. Connected to top sub 18 are upper mandrel 34, sleeve 36, lower mandrel 38, bottom connector sub 40, bottom sub 42, locking sub 44, mandrel 46, and locator sub.

Referring now to FIG. 1, the manner of connection of the components to top sub 18 will be reviewed. Pressure-balanced piston 20 circumscribes in part top sub 18 with seals 50 and 52 in between. Seals 50 and 52 isolate variable volume cavity 54 from the central flowpath 56. Upper mandrel 34 is also connected to top sub 18 at thread 58. The threaded connection 58 is secured by set screw 60. A port 62 extends laterally from central flowpath 56 into variable volume cavity 54. A seal 64 is disposed adjacent the threaded connection 66 to isolate variable volume cavity 68 from the outside of upper housing 26. Threaded connection 66 connects the pressure-balanced piston 20 to upper housing 26. Sleeve 36 is connected to the lower end of upper mandrel 34 at threaded connection 70, secured by set screw 72 and sealed by seal 74. Seal 74 also works to isolate variable volume cavity 68 from central flowpath 56. Sleeve 36 is connected to lower mandrel 38 at thread 90, which is secured by set screw 92. At the lower end of upper housing 24, housing 26 is connected at thread 76, with the set screw 78 retaining the threads engaged. Seal 80 also helps to seal off variable volume cavity 68 from the outside of housing 26. Abutting sleeve 36 is seat assembly 82, which includes a seating surface 84 and a shear pin 86 to selectively hold the position of seat assembly 82 to lower mandrel 38. A seal 88 is disposed between sleeve 36 and seating assembly 82. For ease of replacement of seat assembly 82, the shear pin 86 extends through ring 94. As seen in FIG. 3, when shear pin 86 breaks, ring 94 remains stationary, held in position by lower mandrel 38, with seat assembly 82 shifting downwardly, effectively leaving surface 96 unsupported, allowing for radial outward flaring of seating surface 84. As will be later explained, this allows the ball 98 (see FIG. 2) to pass seating surface 84.

A lateral port 100 allows fluid communication from central flowpath 56 into variable volume cavity 68 at a point adjacent collet heads 102. As seen in FIG. 1, the collet heads 102 are trapped between tapered surface 104 on lower mandrel 38 and surface 106 on upper housing 24. The collet heads 102 are connected to collet ring 108, which is connected by thread 110 to split nut 112. Split nut 112 is slidably mounted to surface 114 of compensating piston 116. Seals 118 and 120 are mounted to the compensating piston 116. Seal 120 seals between compensating piston 116 and housing 26, while seal 118 seals between compensating piston 116 and lower mandrel 38. Compensating piston 116 is movable within variable volume cavity 68 for reasons which will be described below. Bottom connector sub 40 acts as a travel stop for compensating piston 116, as shown in FIG. 3. Thread 122 secures bottom connecting sub 40 to lower mandrel 38. Set screw 124 secures the threaded connection 122, and seal 126 seals between the two members 38 and 40. Similarly, thread 128 connects bottom connecting sub 40 to bottom sub 42, with set screw 130 securing the threaded connection 128 and seal 132 sealing off the same connection.

Continuing down with housing 26, thread 134 connects housing 26 to piston extension 28, with set screw 136 securing the connection. Similarly, thread 138 connects piston extension 28 to adjustment ring 30, and thread 140 connects adjustment ring 30 to adapter sleeve 32. In the run-in position shown in FIG. 1, raised surface 142 traps locking keys 144. As shown in FIGS. 2 and 3, shifting of adapter sleeve 32 with respect to locking keys 144 moves surface 142 away from locking keys 144, thus unlocking them. See FIG. 3. The locking keys 144 are unlocked when surface 146 appears opposite locking keys 144, as shown in FIG. 3. Adapter sleeve 32 has a lower end 148, which is in alignment with packer setting sleeve 150. The packer assembly 14, as previously stated, is contemplated to be a type known in the art, which is settable by a setting sleeve, such as 150. As seen from FIGS. 2 and 3, downhole motion of adapter sleeve 32 impacts setting sleeve 150 to set the packer assembly 14.

Switching back to bottom sub 42, thread 152 secures bottom sub 42 to locking sub 44. Stop ring 154 is connected by thread 156 to locking sub 44. Seal 158 seals between locking sub 44 and bottom sub 42.

A lateral port 160 extends from the central flowpath 56 into variable volume cavity 162. Seals 164 and 166 seal off variable volume cavity 162. Rotational lock 168 has several features. Adjacent its top end is a threaded connection 170 to secure retaining nut 172. Retaining nut 172 bridges over and loosely retains retaining ring 174 loosely against locking sub 44. Ultimately, as illustrated in FIGS. 2–3, applied pressure in port 160 shifts rotational lock 168 until retaining ring 174 falls into groove 176 on locking sub 44. Rotational lock 168 has a series of windows 178 through which locking keys 144 extend. One or more locking keys 144 can be used without departing from the spirit of the invention. Locking sub 44 has a recessed surface 180. In the run-in position, shown in FIG. 1, locking keys 144 are trapped between surface 142 on adapter sleeve 32 and recessed surface 180 on locking sub 44. Locking sub 44 has a series of splines 182 which extend into slots (not shown) in rotation lock 168. The lower end 184 comprises a series of fingers which extend into mating grooves 186 on the packer assembly 14. Accordingly, the ends 184, while extending into the longitudinal grooves 186, cannot rotate with respect to packer assembly 14.

Thread 188 is at the lower end of locking sub 44 and connects locking sub 44 to mandrel 46. The connection is sealed by seals 190. Mandrel 46 has at least one keyway 192 in which is located a key 194. Key 194 extends the substantial length of keyway 192 and through keyways (not shown) machined into locking collet 196, as well as latch 198. Latch 198 has a plurality of collet fingers 200. On the outer face of collet fingers 200 is preferably a left-hand thread 202 which adapts to a similar thread on the packer assembly 14 in the area adjacent grooves 186. In the run-in position, the collet fingers 200 are supported by unbalanced piston 204, which is optionally secured in its run-in position by shear screw 206. Port 208 communicates with variable volume cavity 210, which is in turn sealed by seals 212 and 214. Cavity 216 is exposed to annulus pressure, which in turn tends to put an upward force on unbalanced piston 204 at its lower end 218. An opposing force is exerted on surface 220 as a result of fluid pressures applied from central flowpath 56 through port 208 into variable volume cavity 210.

In the run-in position, the unbalanced piston 204 is not only secured to its position optionally by shear screw 206, but it also abuts the lower end 222 of locking collet 196. Locking collet 196 is itself trapped between surface 224 and recess 226, located respectively on rotational lock 168 and mandrel 46. As will be explained later, locking collet 196 can become liberated from its longitudinally interengaged position with respect to mandrel 46 when shifting of rotational lock 168 presents surface 228 opposite locking collet 196, as shown in FIG. 3. It should be noted that presenting surface 228 opposite locking collet 196 does not necessarily make unbalanced piston 204 move, which would in turn make locking collet 196 move out of recess 226. It takes the sufficient application of an unbalanced force in the annulus over that in central flowpath 56 to actuate movement of unbalanced piston 204, as will be explained below and is illustrated by comparing FIGS. 3 and 4.

Accordingly, key 194 prevents relative rotation as between mandrel 46 on one hand and locking collet 196 and latch 198 on the other hand. As previously stated, rotational lock 168 is also prevented from relative rotation with respect to locking sub 44 due to splines 182 on locking sub 44 extending into longer slots (not shown) in rotational lock 168.

Spring 230 is installed optionally and facilitates assembly of the components of the apparatus A.

Initially supporting the unbalanced piston 204 is locator sub 48. Locator sub 48 has an internal thread 230 to which is connected a bypass tube 232, shown schematically. Bypass tube 232 continues and ends at lower end 234, shown in FIG. 6. An external thread 236 connects a schematically shown outer tube 238, which extends through the packer assembly 14 and into housing 240, shown in FIG. 6. As a result, an annular space 242 is created between bypass tube 232 and outer tube 238 for purposes of use of the crossover assembly C, as will be explained below.

Referring now to FIG. 6, some of the details of the crossover assembly C will be described. Bypass tube 232 sealingly slides into housing 240, with the connection sealed by seal 242. Housing 240 has an inner bore 244, which extends through the entire housing 240, which is shown in FIG. 6 to be made of several component pieces. Valve 246 is held in the open position during run-in by a tang 248. As seen by comparing FIG. 6 to 7, eventually sleeve 250 is urged to rotate as ball 252 is urged downwardly through spiral slot 254 by the advancement of sleeve 258. The rotated position of sleeve 250 is shown in FIG. 7, with valve 246 urged into the closed position due to spring 256. Sleeve 258 is also mounted within housing 240 and contains a seat 260, which ultimately catches ball 98, as shown in FIG. 7. When ball 98 seats on seat 260, it shifts sleeve 258 downwardly, breaking shear screws 264 and forcing sleeve 258 downwardly with respect to housing 240. This downward shift ramps retaining members 266 along tapered surface 268, thus retaining ball 98 in a fixed position seated against seat 260. It should be noted that different forms of retaining mechanisms can be employed other than ball 98 without departing from the spirit of the invention. Similarly, different types of shapes can be used other than spheres without departing from the spirit of the invention. What is significant is to obtain a pressure seal to allow pressure buildup and to be able to retain that seal even though differential pressures go to zero or, in fact, are reversed, meaning the unseating pressure exceeds the seating pressure at ball 98 or whatever similar mechanism is used to retain the seal. During the run-in position, the port 262 is covered by sleeve 258 so that flow can go from the surface through central passage 56, as shown in FIGS. 1–4, down passage 244 and out to the bottom of the liner (not shown). This is an advantage over previous designs since the assembly of the present invention allows for circulation or reverse circulation down to the bottom of the liner without fear of actuation of the setting mechanism for the packer assembly 14 or without fear of disconnection at left-hand thread 202. Not only pressure, but rotation can be applied for the initial circulation down to the bottom of the liner (not shown) to clear up debris from the wellbore. Of course, when needing to do a gravel pack job, the crossover assembly C, as illustrated in FIGS. 6 and 7, is used. Otherwise, the crossover assembly C can be eliminated in favor of simply running a liner (not shown) in conjunction with the packer assembly 14 with the addition of a second place to seal off flowpath 56 at any point below port 160.

Having seated ball 98 on seat 260 and shifted sleeve 258 downwardly, which causes sleeve 250 to rotate and release valve 246, the crossover assembly C is now in the crossover position shown in FIG. 7. In the crossover position, the gravel can be fed into bore 244, which is now interrupted by ball 98. However, port or ports 262 are now open for the gravel to exit housing 240 and to deposit on the outside of the liner (not shown). The fluid passes around under the bottom of the liner, leaving the gravel behind and returning into the lower end of housing 240 back into bore 244 below ball 98. The pressure, which is supplied from the surface to deliver the gravel to the outside of the liner (not shown), provides the motive force for continuing flow uphole in bore 244 so as to eventually overcome the force of spring 256 and urge valve 246 back into the open position. The returning fluids cross over through port or ports 270 up through longitudinal bores 272 and in through the packer assembly 14 and back out into the annulus (not shown) uphole from packer assembly 14. Arrows 274 illustrate this flowpath in FIG. 7.

All of the significant components of the apparatus now having been described, its operation will be reviewed, starting with the run-in position of FIG. 1. As shown in the run-in position in FIG. 1, the apparatus A is fully locked against any release of left-hand thread 202, as well as any setting of the packer assembly 14 by application of pressure, either in the annulus outside the apparatus A or pressure applied in central passage 56. It should be noted that it is within the scope of this invention to provide a locking mechanism for the packer assembly 14, wherein the lock assembly provided prevents accidental release of the packer assembly 14 in the face of applied rotation such as could occur if the string is stuck on insertion or removal. Additionally, it is also one of the aspects of the present invention to provide not only a rotational lock against accidental disengagement, but also a lock against inadvertent setting of the packer assembly 14 due either to applied pressure or rotational forces.

As noted previously, the piston 20 is pressure balanced, meaning that without obstruction of central passage 56 between ports 100 and 62, movement of piston 20 cannot occur since equal and opposite forces on piston 20 will always be present in variable volume cavities 54 and 68, which cancel each other out. As shown by comparing FIG. 1 and FIG. 2, the ball 98 is dropped until it seats against seat 84. While a ball has been shown to effect an unbalanced force on piston 20, other mechanisms can be used which are essentially in pressure balance until a deliberate act is taken to create a situation conducive to a pressure imbalance. Other mechanical or hydraulic or hybrid mechanisms that do not actuate until a deliberate act is done other than a twist, a longitudinal force or applied pressure can also be within the scope of the invention. When the ball 98 in the preferred embodiment is seated against seat 84, pressure can be built up from the surface, which communicates directly into variable volume cavity 54. Since the built up pressure in central passage 56 exceeds the pressure in the annulus (which would be then the same as the pressure downstream of seated ball 98), the pressure in variable volume cavity 54 is raised to a level greater than variable volume cavity 68. As a result, piston 20 shifts downwardly, as well as all of the other components hooked up to it rigidly, which include upper housing 24, housing 26, piston extension 28, adjustment ring 30, and adapter sleeve 32.

In order to move piston 20 downwardly, shear pin 22 is broken, as shown in FIG. 20 Further, as a result of shifting of piston 20, surface 106 on upper housing 24 moves away from collet heads 102, thus allowing collet heads 102 to move radially outwardly toward surface 276 of upper housing 24. Since movement of piston 20 enlarges variable volume cavity 54, but decreases the volume of variable volume cavity 68, the displaced volume of variable volume cavity 68 is compensated by allowing compensating piston 116 to move downwardly, as shown in FIG. 3. Compensating piston 116 can make this movement because of the shifting of piston 20 which has just liberated the collet heads 102, which in turn have held the compensating piston 116 in a fixed position, as shown in FIGS. 1 and 2. The fully released and final position of compensating piston 116 is shown in FIG. 3. The provision of compensating piston 116 is necessary because at times the central passage 56 is located in a position where the flowpath can be deliberately obstructed near the bottom of the liner assembly (not shown). In those situations, the displaced liquid volume due to motion of piston 20 cannot escape through port 100 because of the lower end obstruction in the flowpath 56 at the bottom of the hole. For example, a second packer or plug may be in the bottom of the hole and the procedure may call for setting down the liner on the plug in such a manner as to obstruct the flowpath 56. To avoid locking piston 20, the liberation of compensating piston 116 by release of collet heads 102 allows piston 20 to move downwardly, while at the same time the displaced volume is compensated by movement of piston 116.

Movement of piston 20 ultimately brings lower end 148 in contact with packer setting sleeve 150 which, upon displacement of setting sleeve 150, sets the packer assembly 14 in the customary manner. As these movements are occurring, raised surface 142 moves away from locking keys 144 and, instead, surface 146 presents itself opposite locking keys 144. Once this occurs, locking keys 144 are free to clear recess 180 which then releases the interengaging relationship between locking sub 44 and rotational lock 168. When this occurs, as shown in FIG. 3, there as yet is no relative longitudinal movement between rotational lock 168 and locking sub 44.

Sequentially, the next step that occurs after shifting of piston 20 is the increasing of surface pressure in flowpath 56 until the applied force transferred from ball 98 to seat 84 exceeds the shear resistance of shear pin 86. At that time, as shown in FIG. 3, shear pin 86 breaks. The uphole pressure on ball 98 forces seat assembly 82 downwardly such that surface 96 moves off of ring 94 and becomes unsupported as it faces surface 278 of lower mandrel 38. At this time, due to the lack of support for the lower end of seat assembly 82, it literally flares outwardly allowing ball 98 to pass beyond seat 84. The deformation of seat assembly 82 may be elastic or plastic. Alternative mechanisms can be used to selectively retain ball 98 and subsequently release it upon application of further pressure. Different mechanisms can be used to isolate flowpath 56 between port 62 and 100 so as to permit the application of an unbalanced force to piston 20 without departing from the spirit of the invention. What is illustrated is the preferred embodiment of initiating the motion of balanced piston 20.

As shown in FIG. 3, when sufficient pressure has been applied to ball 98, it clears seating surface 84 and travels down path 56 to seat 260, shown in FIG. 6. By this time, the ball 98 has traveled through the packer assembly 14 and has entered the crossover assembly C. At this time, additional pressure from the surface may be required to actuate the movements in the crossover assembly C. Upon application of further pressure from the surface, sleeve 258 moves downwardly shearing pin 264. As sleeve 258 shifts downwardly, it forces ball 252 along slot 254. Since sleeve 258 is locked against rotation and sleeve 250 is free to rotate, but not to translate, the longitudinal movement of sleeve 258 translates to a rotational movement of sleeve 250. Consequently, tang 248 moves away from valve 246 allowing spring 256 to bring the valve 246 to its closed position shown in FIG. 7. The shifting of sleeve 258 has also now exposed port or ports 262 and has allowed a flowpath to be created from bore 244 out through ports 262 and through the housing 240 into the annular space outside of the liner assembly, not shown, which is normally suspended from the lower end of packer assembly 14. It should be repeated that the crossover assembly C is an optional feature useful in a gravel packing procedure and may be completely omitted if gravel packing is not required. In either event, a seat 260 is provided so as to sealingly capture ball 98 after it is liberated by seat assembly 82.

Another consequence of shifting sleeve 258 is that balls 266 are driven along tapered surface 268 and in effect lock the ball 98 to seat 260. Thereafter, even if differential pressures are applied to ball 98 in either direction, ball 98 will not come away from seat 260. Sometimes during the circulation or reverse circulation operations involved crossover sub C, the seating pressure on ball 98 can literally disappear, and it has been learned in the past that the sealing integrity at seal 260 is lost. In these situations, the ball either floats slightly above the seat 260 or due to a reverse in pressures, can literally be driven up bore 244 and bore 56 to a position making it hard to find and reposition against seat 260. Accordingly, one of the aspects of the invention is to provide a retaining mechanism, the preferred embodiment of which is illustrated in FIGS. 6 and 7 using balls 266. However, other mechanical or hydraulic devices which physically retain the sealing member, in this case a ball 98 to a seat 260, are also within the purview of the invention.

Prior to the movements above, having seated ball 98 on seat 260, pressure is then raised from the surface into flowpath 56, which now, through passage 160, allows pressure to build up in volume cavity 162, as seen by comparing FIGS. 2 and 3. This buildup occurs because shear pin 264 keeps sleeve 258 in a position covering ports 262. As the volume of variable volume cavity 162 increases, rotational lock 168 moves upwardly, taking lower end 184 out of grooves 186. At that point, the rotational lock between the packer assembly 14 and the components above is completely defeated. As rotational lock moves upwardly, retaining ring 174 comes into alignment with groove 176, in effect locking rotational lock 168 in the position shown in FIG. 3. At this point, a twisting force can be applied to top sub 18 to the right, which will disengage left-hand thread 202.

A hydraulic release is also possible by applying annular pressure outside the apparatus A which freely communicates with variable volume chamber 280. With the packer assembly 14 set and annular pressure applied to variable volume cavity 280, an imbalance occurs on unbalanced piston 204. An optional shear pin 206 ultimately breaks as the uphole pressure from the annulus applied to lower end 218 of unbalanced piston 204 exceeds the downhole pressure on unbalanced 204 through port 208, sending unbalanced piston 204 moving upwardly. However, before the unbalanced piston 204 can move upwardly, the lock of locking collet 196 extending into recess 226 must be defeated. This occurs as rotational lock 168 shifts upwardly, moving surface 224 away from locking collets 196 and presenting surface 228 opposite locking collet 196, as shown in FIG. 3. Once this occurs, the locking collet 196 is free to move longitudinally, as seen by comparing its position in FIG. 3 to FIG. 4. Simultaneously or thereafter, the unbalanced forces on piston 204 move it uphole, as shown by comparing FIGS. 3 and 4. Piston 204 essentially becomes unlocked as the locking collet 196 is itself liberated to come out of groove 227. With the piston 204 fully shifted, collet fingers 200 become unsupported, as shown in FIG. 4. At that point, an upward pull from the surface can disengage left-hand thread 202, as the portion of the thread on collet fingers 200 merely ride over the mating thread on the packer assembly 14. At this point, the release procedure is concluded.

It should be noted that a hydraulic release is not possible by applying pressure in flowpath 56. The only way application of pressure can result in release of the packer assembly 14 is if the pressure is applied to the annulus with packer 14 set. Therefore, during the initial run-in procedure, hydraulic pressure can be applied either through the central flowpath 56 or outside the apparatus A in the annulus and the packer assembly 14 will not release. This is because the locking collets 196 prevent longitudinal disengagement. At the same time, the lower ends 184, when inserted into grooves 186, prevent relative rotation between the assembly above packer assembly 14 and packer assembly 14. Accordingly, a release of the packer assembly 14 due to a twisting force applied from the surface is also prevented by virtue of the lower end 184 of rotational lock 168 being in position in grooves 186. As it is set up the rotational lock 168 is trapped by virtue of locking keys 144 extending into recess 180. Since the locking keys 144 themselves cannot be liberated until piston 20 is shifted, it can readily been seen that since piston 20 is in pressure balance, no application of hydraulic force in flowpath 56 or in the annulus outside the apparatus A can actuate the piston 20 to move. Similarly, a twisting force applied from the surface during the run-in position will also be ineffective to release the packer assembly 14 or to set the packer assembly 14 in the wellbore.

At times it may be desirable to perform what is known in the art as a "squeeze job." This occurs when fluid is forced under pressure into the formation for a variety of purposes. In order to accomplish this, especially in using the crossover sub C, a let down force can be applied to top sub 18, which in effect blocks the flow illustrated by arrows 274 in FIG. 7 at the exit point from housing 240. In essence, the flow can proceed down through port 262 with then the only outlet being into the formation since ball 98 blocks bore 244 and the set down force on top sub 18 has in effect blocked the exit from bores 272. The apparatus of the present invention allows for such positioning, which in turn has the effect of blocking the outlets of bores 272 further uphole by closing them off when they are retracted into packer assembly 14 in a manner well-known in the art.

The apparatus of the present invention provides a rotational lock, which allows retention of a packer assembly 14 without fear of inadvertent disconnection or setting of the packer assembly 14. Further, a hydraulic lock is also provided. This allows use of pressure to clear debris without fear of disconnection from the packer assembly 14 or setting the packer assembly 14. The apparatus A provides for control over the timing of the setting and/or release of the packer assembly 14. Additionally, improvements have been made to a crossover assembly which allows retention of the ability to deposit gravel without fear of loss of seal due to lack of sealing pressure differential. Additionally, one of the preferred embodiments illustrated simplifies the procedure by allowing systematic reuse of a sealing mechanism to accomplish different movements of the apparatus A instead of having to sequentially position auxiliary sealing members from the surface. In the preferred embodiment, the ball 98 is reused by pushing it through seat 84, only to catch it again on seat 260 and thereafter retain it against floating away. Even with a crossover sub C, circulation or reverse circulation to the bottom of the liner to remove debris is possible prior to initiating shifting of the crossover sub C into the crossover position without fear of setting the packer assembly 14 or releasing it prematurely.

An alternative embodiment of the present invention is illustrated in FIGS. 8–12. The changes from the embodiment illustrated in FIGS. 1–5 occur primarily in the area of where ball 98 initially seats and down further regarding the mode of unlocking the hydraulic release in the area of locking keys 144. The major components of the apparatus A have been shown in simplified form in FIGS. 8–12 by removal of interconnections which are used to put together the outer sleeve 21. To avoid repetition, not every function of the apparatus A will be described again, only those functions which are specifically different than the embodiment shown in FIGS. 1–5. Where there is some duplication in shape or function, similar numerals have been used to identify the components.

Figure 8C:
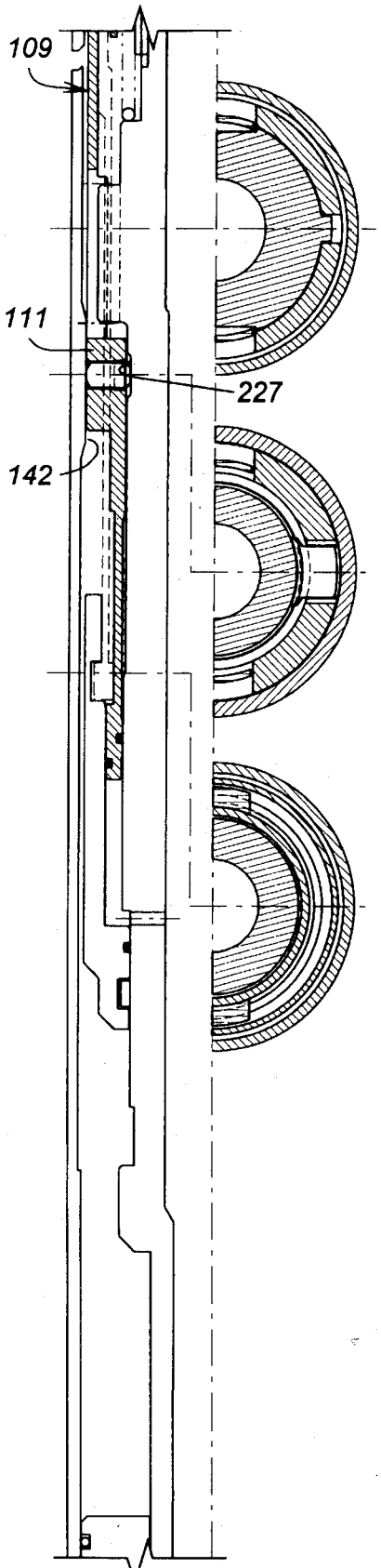
Figure 8D:
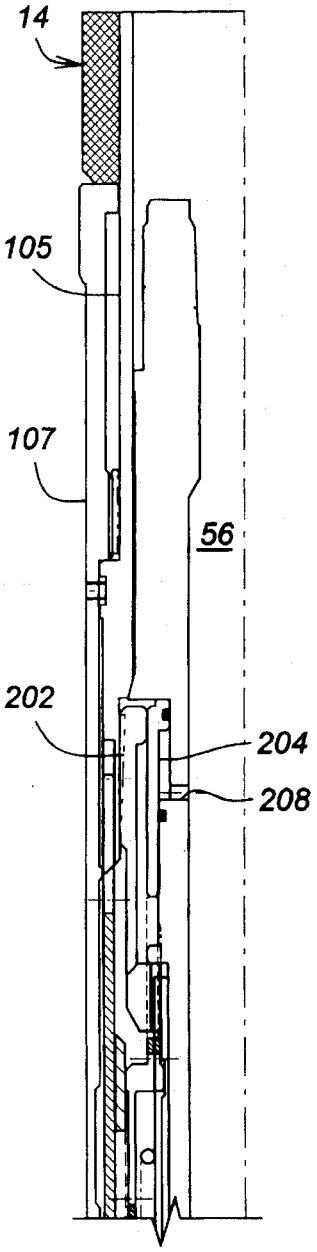

Looking now at FIGS. 8A–D, the apparatus A of the alternative embodiment is illustrated in its run-in position. At that point, shear pin 22 retains outer sleeve 21 to top sub 18. As shown in FIG. 8D, the packer element 14 is in the relaxed position for a run-in. Top sub 18 is threaded at thread 70 to ring 23, with the threaded connection secured by set screw 72. Seal 74 seals off the threaded connection 70. Ring 23 is threaded at thread 25 to seat 27. Seat 27 is nested within seat support ring 29. Seat 27 is shown in greater detail in FIG. 14, while seat support ring 29 is shown in greater detail in FIG. 13. As shown in FIG. 13, seat support ring 29 has an annular ring 31 which is used to limit its ultimate movement as will be described below. A plurality of shaped fingers 33 extend from annular ring 31 and have a slight taper 35, preferably in the order of about 15°, followed by cylindrical section 37 and another tapered section 39, preferably at about 45°. Tapered section 35 fits over taper 41 of seat 27 (see FIG. 14). Similarly, cylindrical section 37 sits over cylindrical section 43, while tapered section 39 of the seat support ring 29 sits over tapered section 45 of seat 27. Seat 27 features a plurality of cutouts 47 which extend longitudinally through cylindrical surface 45. Seat support ring 29 has a plurality of cutouts 49 which are considerably longer, preferably by about a factor of 10 from cutouts 47. Cutouts 49 on seat support ring 29 extend through tapered section 39, cylindrical section 37, tapered section 35 and on beyond into cylindrical section 51 stopping short of annular ring 31. The cutouts 47 are shorter to give the seat 53 where ball 98 will ultimately catch (see FIG. 9B) sufficient strength to support the ball to allow pressurization activities as will be described. By the same token, seat 53 must be resilient enough so that it can plastically deform a sufficient amount upon differential pressure buildup beyond the present point so as to pass ball 98 to the next seating point below in flowpath 56.

Figure 10B:
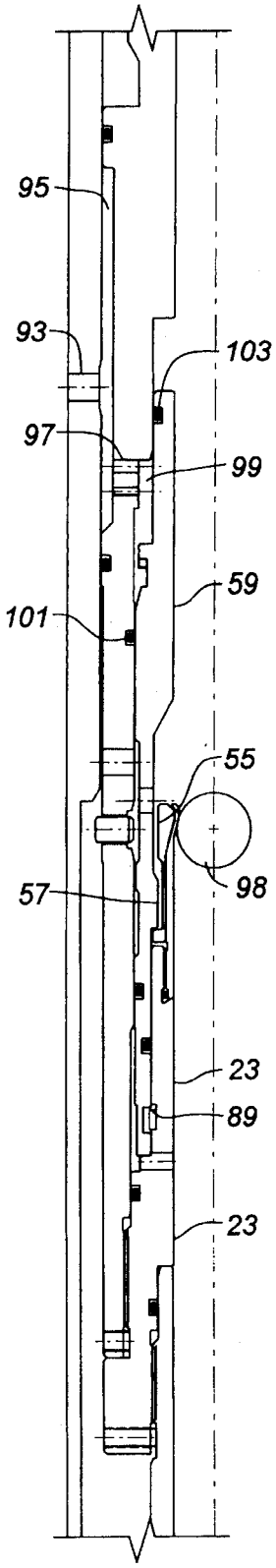
Figure 9C:
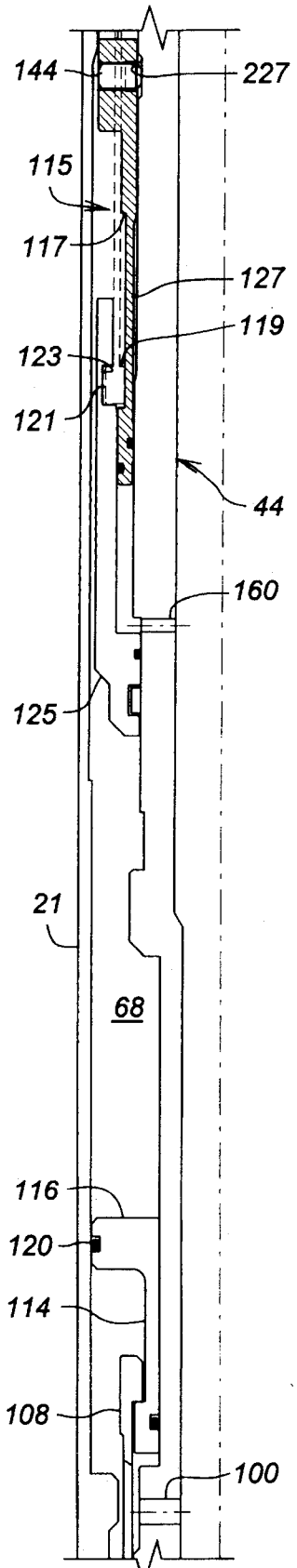
Figure 10C:
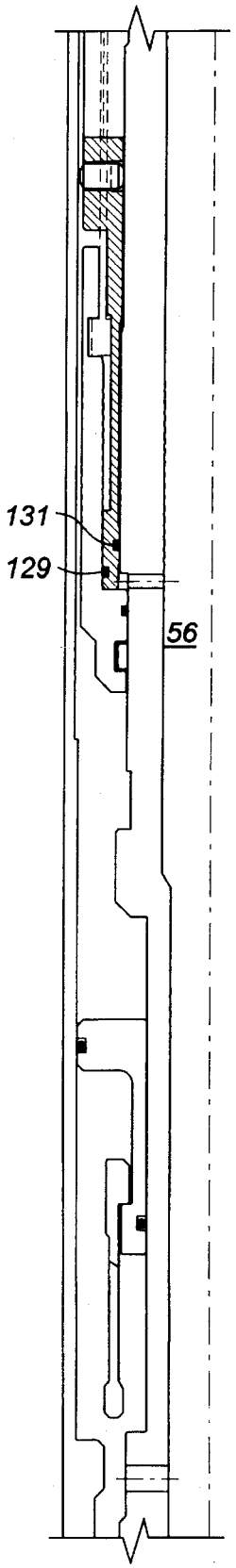

The seat support ring 29 has to have sufficient flexibility to flex outwardly a sufficient amount to accommodate the outward flexing of seat 53 when ball 98 is urged by sufficient differential pressure to pass to its next seating point below in flowpath 56. Accordingly, the finger structure 33 of support ring 29 acts to allow ball 98 to pass. It should be noted that fingers 33 have an outer cylindrical surface 55 which, in the run-in position, rests on shoulder 57. Shoulder 57 is on movable seat ring 59. In the run-in position, movable seat ring 59 is disposed between ring 23 and inner sleeve 61. Inner sleeve 61 has a plurality of openings 63 in which are disposed lock pins 65. In the run-in position shown in FIG. 8B, lock pins 65 extend into groove 67 on movable seat ring 59. Ultimately, inner sleeve 61 is connected to ring 23 at thread 69 with seal 71 disposed therebetween. Cavity 73 is defined between inner sleeve 61 and ring 23 just below seal 71. Movable seat ring 59 translates within cavity 73 as will be described below. Movable seat ring 59 is sealed in its longitudinal movement in cavity 73 against inner sleeve 61 and ring 23, respectively, by seals 75 and 77. Inner sleeve 61 is sealingly engaged to outer sleeve 21 by virtue of seal 79. The run-in position of movable seat ring 59 is retained by virtue of shear pin 81 which extends through inner sleeve 61 and into groove 83 in movable seat ring 59. Movable seat ring 59 has a groove 85 which houses a lock ring 87. Ultimately, upon movement of seat ring 59 in cavity 73, lock ring 87 catches groove 89 on ring 23, as shown in FIG. 10B.

Figure 9A:
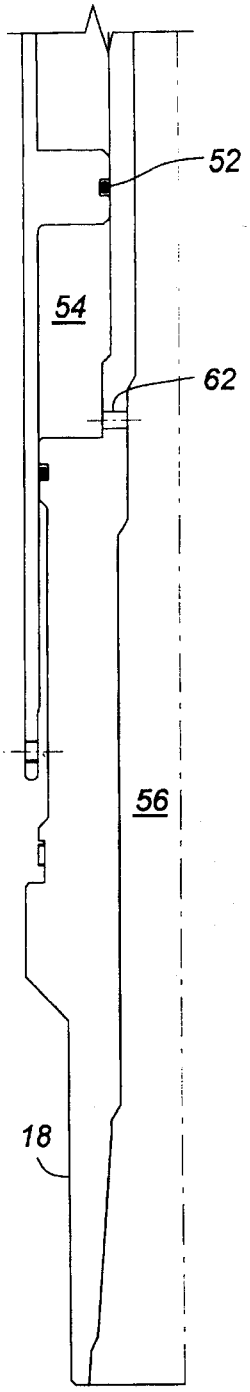
Figure 9B:
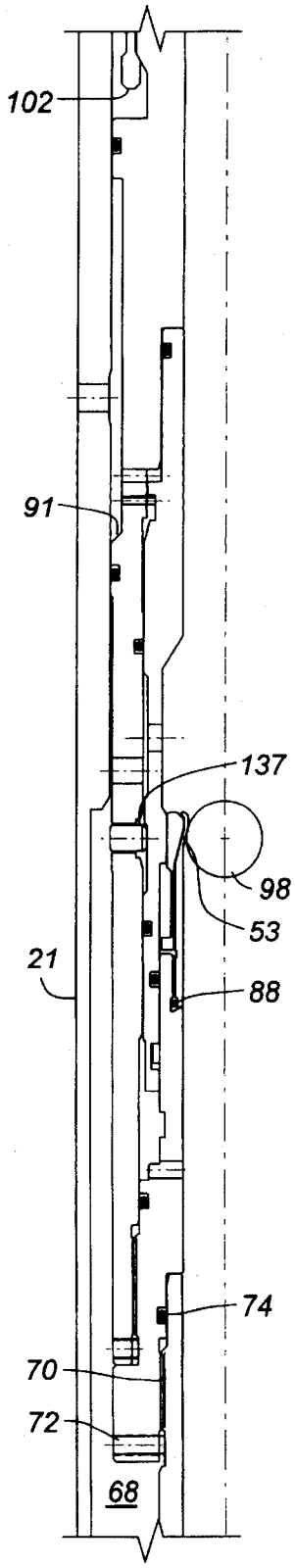
Figure 11A:
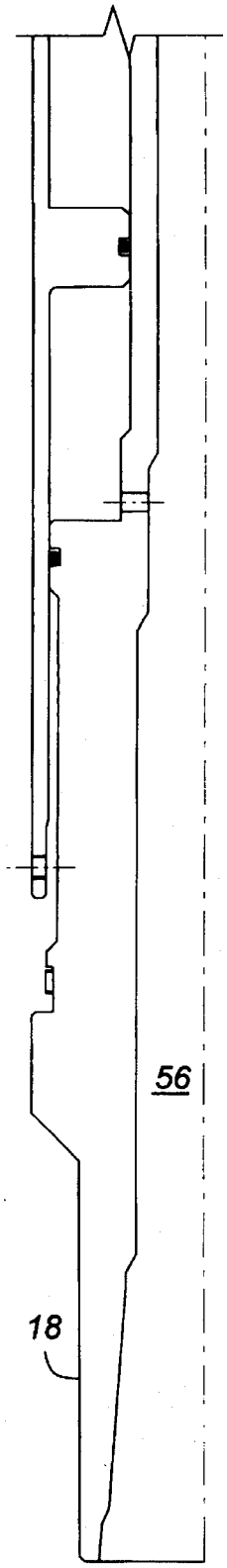
Figure 11B:
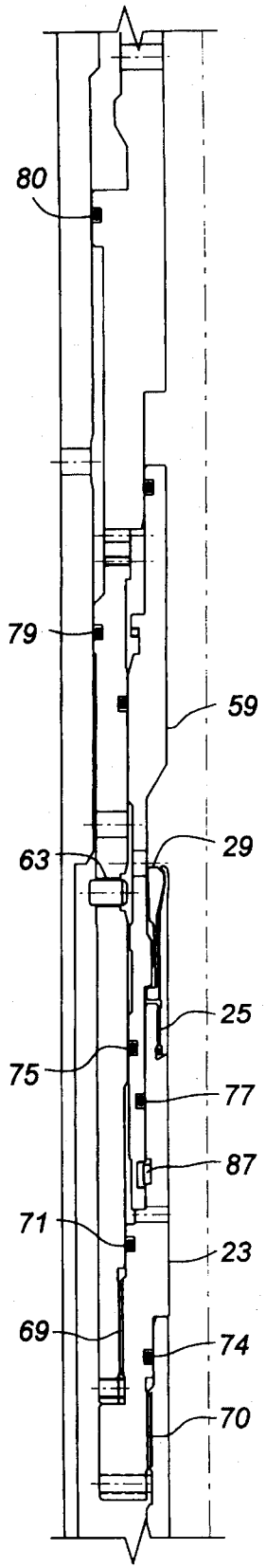
Figure 12B:
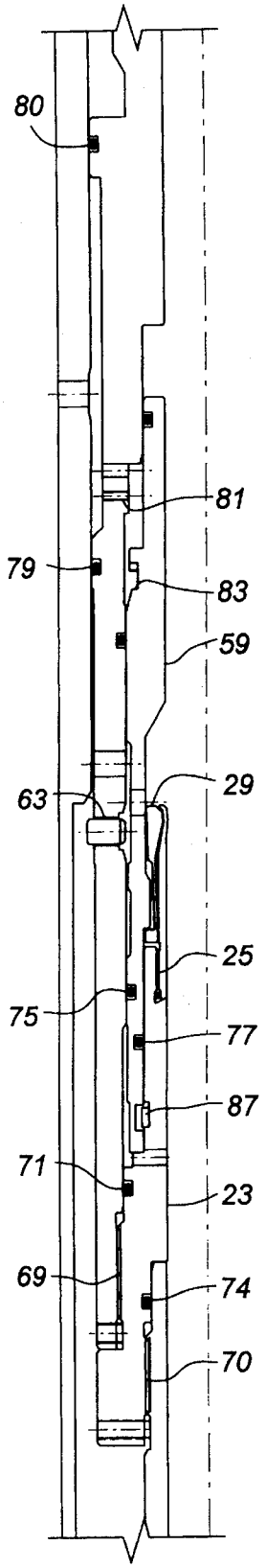
Figure 11C:
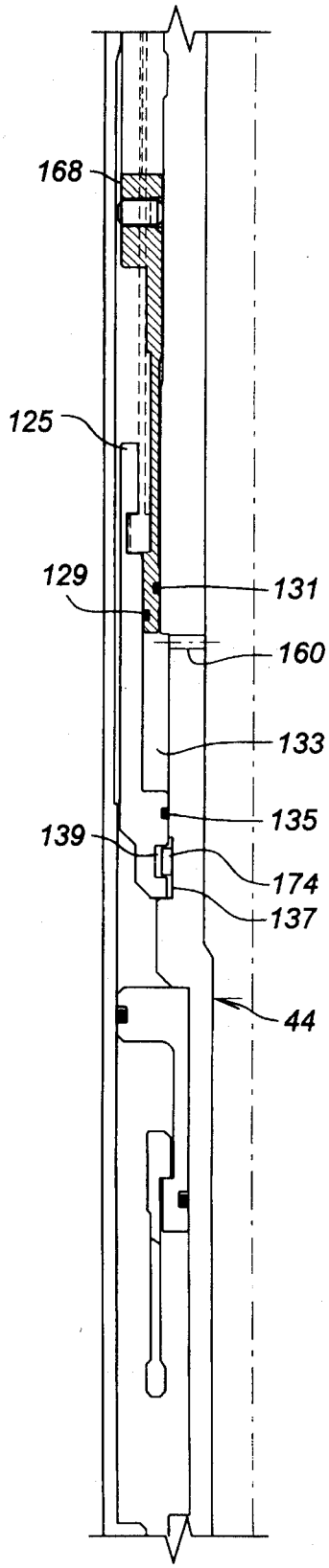
Figure 12C:
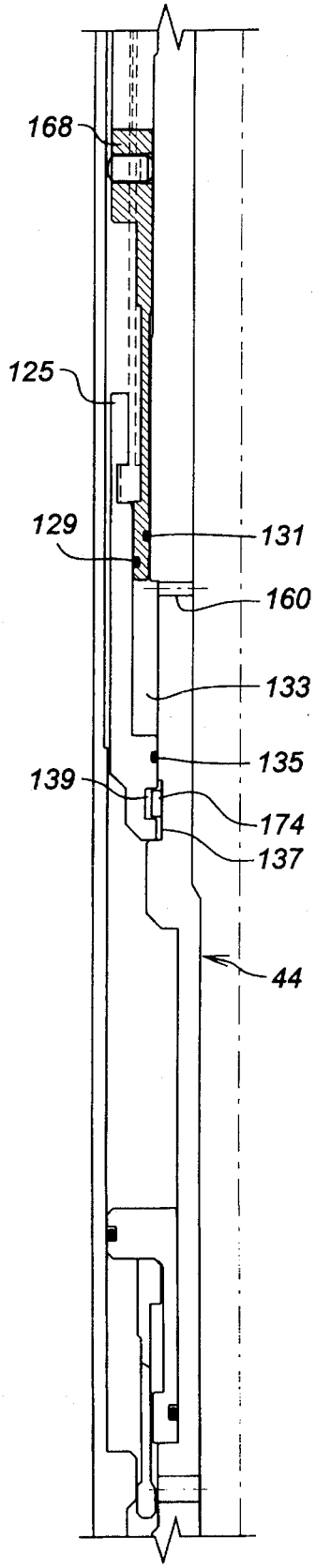
Figure 11D:
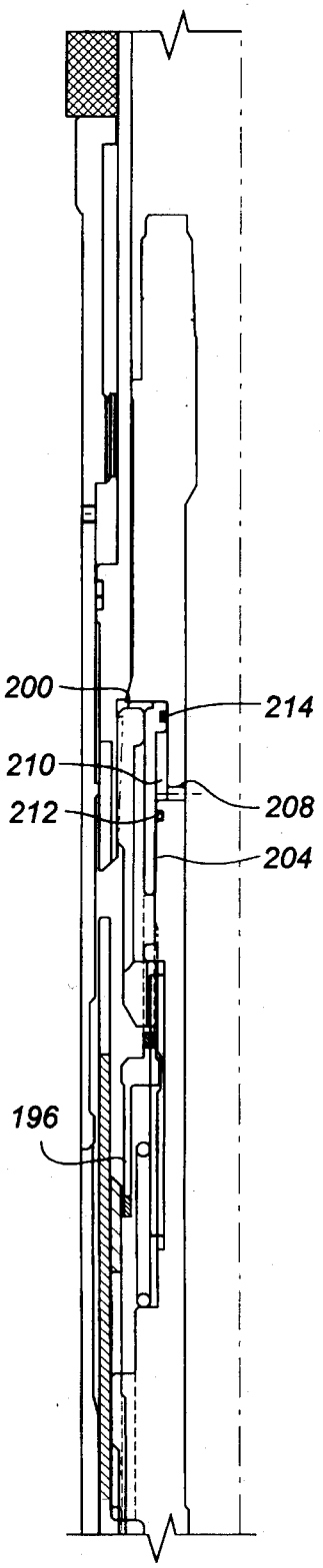
Figure 12D:
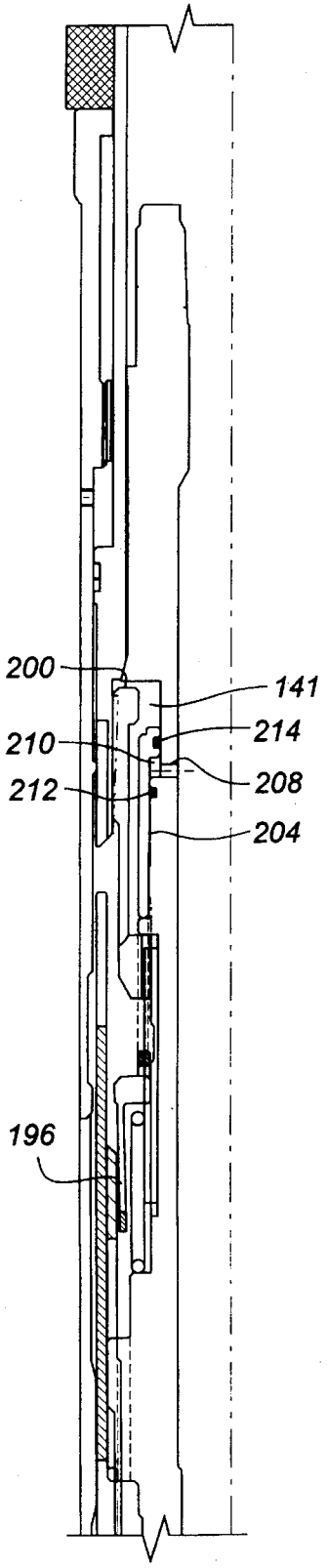

The components for the seating of ball 98 having been described, the operation will now be covered in greater detail. After the apparatus A is placed in the proper position, ball 98 is dropped through flowpath 56 as shown in FIG. 9B. Ball 98 catches on seat 53. Seat 53 is supported against radial outward flexing because surface 55 on seat support ring 29 is still abutting shoulder 57. Once ball 98 seats on seat 53, pressure is applied to flowpath 56 above ball 98. This pressure can be in the range of 3000 psig with an actual design capable of handling 7500 psig. The pressure applied enters cavity 54 through port 62, raising the pressure in cavity 54 above cavity 68, thereby shearing shear pin 22 and shifting outer sleeve 21 downwardly to set the packer element 14 in the manner previously described. As a result of the downward shifting of outer sleeve 21, shoulder 91 has shifted away from lock pins 65, thereby rendering them capable of being displaced radially outwardly toward outer sleeve 21. As shown in FIG. 10B, pressure is then applied to the annulus. Annulus pressure passes through outer sleeve 21 through opening 93 into cavity 95. From cavity 95, the applied pressure passes through opening 97 and into cavity 99. Cavity 99 is sealed off by seals 101 and 103. At some predetermined point upon raising the annulus pressure, an unbalanced force is applied to movable seat ring 59 to shift it upwardly. The upward movement of seat ring 59 can be seen by comparing FIGS. 9B and 10B. As a result of such a movement, shoulder 57 has moved away from surface 55 on seat support ring 29. That very same movement has urged lock pin 65 outwardly as can also be seen by comparing FIG. 9B to FIG. 10B. This occurs because shoulder 137 contacts lock pin 65 for outward radial displacement. Eventually shoulder 137 passes upwardly past all of the lock pins 65, as shown in FIG. 10B. At the upper end of its movement of seat ring 59, lock ring 87 comes into alignment with groove 89 such that lock ring 87 extends partly into groove 89, groove 85 thereby retaining movable seat ring 59 to ring 23 (see FIG. 10B). At this time, ball 98 is still retained to seat 53, also as shown in FIG. 10B. However, with surface 55 now unsupported due to the shifting of shoulder 57, an incremental rise in pressure from the surface in flowpath 56 above ball 98 in the order of 700 psig at ball 98 allows ball 98 to pass downwardly beyond the packer assembly 14 to the lower catch point, as previously described in the first embodiment of FIGS. 1–5. As shown in FIG. 11, the pressure is increased from the surface, forcing ball 98 downwardly and pushing radially outwardly the assembly of the seat support ring 29, as well as the seat 27. The grooves 47 in seat assembly 27 permit plastic deformation of seat 53 so that the ball may pass. Similarly, the seat support ring 29, with its elongated longitudinal grooves 49, readily flexes radially outwardly as shown in FIG. 11B to facilitate the radial expansion of seat 53 to allow ball 98 to pass. What has been described is an alternative manner to capture the ball 98 on a first seat 53 than that presented in the embodiment of FIGS. 1–5. The advantage of this alternative embodiment is that minimal differential pressures need be applied to ball 98 to get it to pass seat 53 after shoulder 57 has been removed from its supporting position in contact with surface 55. By substantially lowering the differential pressure required to actuate release of ball 98 down to about 15% of the applied pressure for actuating sleeve 21, preferably under 7000 psi, the downstream elements, particularly seat 260 where ball 98 must catch again, are further protected from a vigorous impact, thus improving their service life. Additionally, the reliability of a sealing contact down below, once ball 98 is released, is also increased.

The alternative embodiment shown in FIG. 8–12 is also modified from the embodiment shown in FIGS. 1–5 in the area of the manner of release of the hydraulic release mechanism. While there is some similarity in the component layout, there are differences as well. The packer assembly 14 includes a housing 105 (see FIG. 8D). Nested outside housing 105 is setting sleeve 107. Hydraulic release is possible by a shifting of unbalanced piston 204 in the manner previously described. When piston 204 is shifted as shown in FIG. 12D, collet fingers 200 become unsupported effectively disengaging left-hand thread 202 from housing 105. In essence, with piston 204 shifted, as shown in FIG. 12D, an upward pull from the surface allows for release from housing 105 on the packer assembly 14 as collet fingers 200 flex radially inwardly allowing thread 202 on the collet fingers to ride out of a matching thread on housing 105.

To explain the process in more detail, the apparatus A is rotationally locked into the packer housing 105 in the run-in position shown in FIG. 8D. This is accomplished by lower end 184 of lock ring 109 extending into grooves 186 in packer housing 105 (see FIG. 9D). In the run-in position 8D, surface 142 on outer sleeve 21 abuts surface 111 on lock ring 109. This juxtaposition of parts forces locking keys 144 into groove 227. At this point, as shown in FIG. 8D, lock ring 109 cannot be shifted with respect to locking sub 44 because they are indexed together by lock pins 144 forced into groove 227 on locking sub 44. In view of this relationship at run-in, a rotational release is not possible as long as lower end 184 extends into grooves 186 of the packer housing 105. A pull release is also not possible since threads 202 are fully supported against packer housing 105 by virtue of unbalanced piston 204.

The initial downward movement of outer sleeve 21 in response to pressurization of cavity 54 (see FIG. 9A) allows outer sleeve 21 to set the packer assembly 14 by pushing down on setting sleeve 107. This can be seen by comparing FIG. 8D to FIG. 9D. The downward shifting of outer sleeve 21 unlocks locking keys 144 by virtue of a shift of surface 142 downwardly away from locking keys 144. Now locking keys 144 can be displaced outwardly and relative motion between locking sub 44 and lock ring 109 is possible but does not necessarily yet occur. Meanwhile, the rotational lock of lower end 184 of lock ring 109 is still in place within grooves 186. At this time, piston 204 is still locked in place because locking collet 196 which abuts it is in effect itself still trapped by virtue of its own extension into groove 226 in locking sub 44. Locking collet 196 is trapped because surface 113 on hydraulic release ring 115 prevents relative movement between locking collet 196 and locking sub 44 (see FIG. 9D).

Figure 9D:
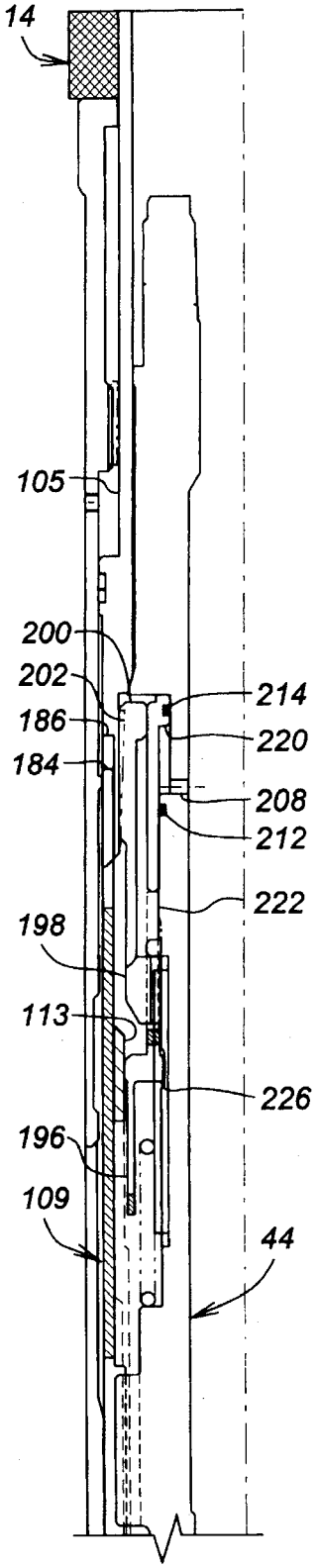
Figure 10D:
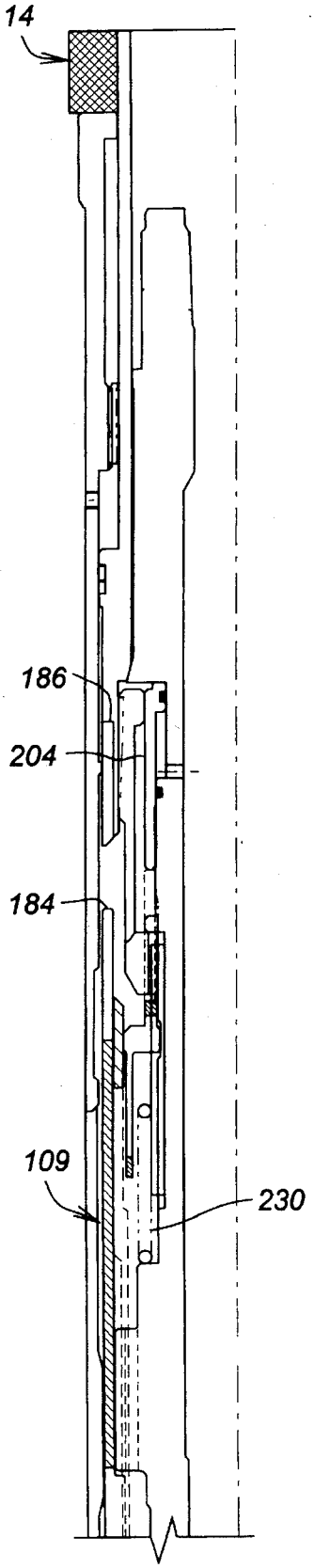
Figure 12A:
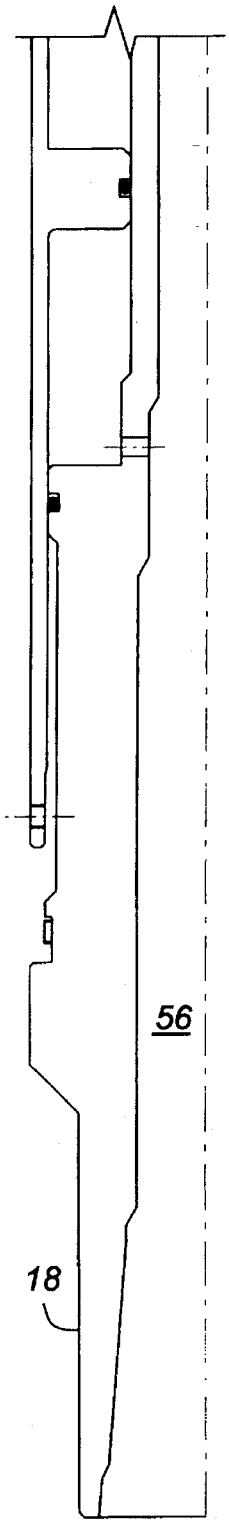

With the packer assembly 14 now set, as shown in FIG. 9D, and the rotational release mechanism of locking keys 144 in effect released, the next step involves annulus pressure which is used to test the hold of the packer assembly 14. The application of annulus pressure puts an unbalanced upward force on lock ring 109, causing it to shift upwardly as can be seen by comparing FIGS. 9C and 9D to FIGS. 10C and 10D. In the course of its upward motion, the locking keys 144 are displaced out of groove 227. Lock ring 109 moves with respect to hydraulic release ring 115. This motion continues until shoulder 117 engages shoulder 119. The hydraulic release ring 115 has an annular ring 121, a portion of which defines shoulder 119. Annular ring 121 extends into groove 123 of collar 125. It should be noted at this time that while pressure is applied to the annulus, as shown in FIG. 10, the hydraulic release ring 115 is in pressure balance and does not move. By virtue of annular ring 121 extending into groove 123, collar 125 remains stationary with hydraulic release ring 115. Annular ring 121 also extends into groove 127, a portion of which defines shoulder 117 to act as a travel stop to relative motion between locking ring 109 and hydraulic release ring 115.

It can readily be seen that the unbalanced force created by annulus pressure shown in FIG. 10 occurs because the upper end of lock ring 109 is exposed to a lower pressure in flowpath 56 than the pressure applied in the annulus. Flowpath pressure 56 communicates through port 160 to the upper end of lock ring 109 where that pressure is insulated from applied annulus pressure by seals 129 and 131. By the time lock ring 109 has traveled to the position shown in FIG. 10C, its lower end 184 has emerged from grooves 186 in packer housing 105. At this point, rotational release is possible from packer housing 105 but the hydraulic release mechanism is still locked. It is only when ball 98 is shifted to its lower seating point and flowpath 56 is again pressurized, as shown in FIG. 11, that the hydraulic release mechanism is defeated. This occurs when pressure build up adjacent port 160 resulting from the lower seating of ball 98 raises the pressure in cavity 133. Cavity 133 is sealed off from annulus pressure by virtue of seals 129 and 131 and 135. At this time, since annulus pressure exerts an upward force on lock ring 109, it does not move downwardly in response to the increased pressure into cavity 133. Instead, the collar 125 moves upwardly until retaining ring 174 can drop into groove 137 while at the same time extending into groove 139. This effectively locks the collar 125 to locking sub 44. When the collar 125 moves upwardly, as seen by comparing FIG. 10C to FIG. 11C, it takes with it hydraulic release ring 115 by virtue of the annular ring 121 extending into groove 123 on collar 125. With the upward shifting of hydraulic release ring 115, locking collet 196 is now freed to move upwardly. The last step involves raising the annulus pressure to create an unbalanced upward force on unbalanced piston 204. In the manner previously described, unbalanced piston 204 sees flowpath 56 pressure through port 208. Port 208 leads to cavity 210, which is isolated from annulus pressure by seals 212 and 214. When piston 204 sees the unbalanced force from annulus pressure in cavity 141 (see FIG. 12D), it moves upwardly, now enabled to do so by virtue of the prior upward movement of hydraulic release ring 115. The unbalanced force on piston 204 literally pushes up locking collet 196, forcing it out of groove 226 as it moves upwardly. With the piston 204 in the position shown in FIG. 12D, collet fingers 200 can flex radially and inwardly on a pull out release of the threaded connection 202 to packer housing 105.

The advantage of the alternative embodiment in FIGS. 8–12 is that the rotational lock is defeated before ball 98 passes seat 53. In the event ball 98 doesn't seat off on its second seat below, a rotational release is possible. The embodiment of FIGS. 1–5 rotational release depended on presenting ball 98 such that if the ball didn't reseat below, disengagement from the packer housing was not possible without destroying the apparatus A.

In all other respects, the embodiments shown in FIGS. 8–12 operate similarly to the embodiments shown in FIGS. 1–5 in combination with the second catch point for ball 98, as illustrated in the mechanism shown in FIGS. 6 and 7.

The foregoing disclosure and description of the invention are illustrative and explanatory thereof, and various changes in the size, shape and materials, as well as in the details of the illustrated construction, may be made without departing from the spirit of the invention.

What is claimed is:

1. A downhole apparatus for positioning a tool, comprising:

positioning means for positioning the tool at a desired point downhole;

actuating means on said positioning means for selectively actuating the tool;

lock means operable on the tool for selective prevention of release of the tool from said positioning means responsive to rotational and longitudinal movements of said positioning means; and said actuating means, when actuated to operate the tool facilitating unlocking of said lock means, at least in part, to allow release between the tool and said positioning means from at least one of rotational or longitudinal movement of said positioning means.

2. The apparatus of claim 1, wherein:

operation of said actuating means facilitates unlocking of said lock means to allow release of the tool by rotation of said positioning means.

3. The apparatus of claim 1, wherein:

operation of said actuating means facilitates unlocking of said lock means to allow release of the tool by longitudinal movement of said positioning means.

4. The apparatus of claim 2, wherein:

the tool is defined having at least one receptacle;

said lock means selectively extending into said receptacle to prevent rotational release of said positioning means from the tool; and said actuating means preventing movement of said lock means out of said receptacle until actuated to operate the tool.

5. The apparatus of claim 4, wherein:

said lock means is disposed for hydraulic actuation to exit said receptacle upon operation of said actuating means to operate the tool.

6. The apparatus of claim 5, wherein:

said actuating means further comprises:

a shifting sleeve;

force unbalancing means on said sleeve for selectively urging said sleeve longitudinally for setting the tool.

7. The apparatus of claim 6, wherein said force unbalancing means further comprises:

a flowpath formed in said positioning means;

a first seat in said flowpath, said flowpath in flow communication with said shifting sleeve on one side of said first seat;

obstruction means engageable with said first seat to allow pressure buildup in said flowpath to said sleeve for actuation thereof.

8. The application of claim 7, wherein:

said first seat is selectively supported to retain said obstruction means upon application of sufficient differential pressure to actuate said shifting sleeve in a first condition, and to allow said obstruction means to pass beyond said first seat at a lower differential pressure when unsupported.

9. The apparatus of claim 8, wherein:

said first seat is selectively supported by a movable sleeve;

said obstruction means comprises a sphere;

said sphere retained against said first seat by applied flowpath pressure;

said movable sleeve responsive to downhole pressure outside said positioning means, whereupon application of an unbalanced force on said movable sleeve resulting from applied downhole pressure said movable sleeve shifts to remove support for said first seat whereupon said sphere is capable of passing said first seat at a reduced differential pressure.

10. The apparatus of claim 9, wherein:

said first seat further comprises:

an elongated member formed defining a taper thereon, said taper is formed in a manner to allow it to plastically deform in the absence of support from said movable member to allow said sphere to pass said taper, with differential pressure across said sphere substantially lower than applied differentials for activation of said shifting sleeve with said first seat supported.

11. The apparatus of claim 10, wherein:

said elongated member is formed having at least one cutout near said taper to selectively weaken it when said first seat is not supported.

12. The apparatus of claim 11, wherein said first seat further comprises:

a support ring circumscribing said elongated member and selectively in contact with said movable sleeve, said support ring having at least one cutout substantially longer than said cutout on said elongated member.

13. The apparatus of claim 12, wherein:

said support ring selectively movable in tandem with said elongated member radially outwardly to allow said sphere to pass;

said support ring and said elongated member having a plurality of longitudinally oriented cutouts extending from one end thereof, said cutouts on said support ring extending over substantially the length of said support ring such that upon removal of support for said support ring negligible resistance to radial outward plastic deformation of said taper is afforded to allow said sphere to pass said seat.

14. The apparatus of claim 3, wherein:

said lock means is formed having an engagement member to selectively retain the tool;

said engagement member having selective radial flexibility;

said lock means further comprising a movable backing member movable selectively with respect to said engagement member to facilitate selective release of the tool from said lock means due to said radial flexibility.

15. The apparatus of claim 14, wherein:

said engagement member further comprises:

a collet assembly engaging the tool;

said movable backing member further comprises:

a movable piston backing up said collet assembly against the tool;

a second seat in said flowpath;

whereupon reseating of said sphere on said second seat and application of flowpath pressure said piston is mechanically unlocked for movement responsive to an unbalanced hydraulic force applied from outside said positioning means;

whereupon shifting of said movable piston said collet assembly becomes unsupported allowing said positioning means to be disengaged from the tool by a longitudinal force.

16. The apparatus of claim 9, wherein:

said lock means is hydraulically actuated to exit said receptacle by the same hydraulic pressure which actuates said movable sleeve.

17. An apparatus for operating a pressure-actuated tool, comprising:

positioning means for positioning the tool at the desired location in the wellbore;

said positioning means formed having a flowpath therein;

an obstructing element insertable into said flowpath for selective obstruction thereof;

seat means in said flowpath for selectively retaining said obstructing element and for release of said obstructing element by plastic deformation.

18. The apparatus of claim 17, wherein:

said seat means comprises:

a first seat selectively supported in said positioning means;

whereupon when said seat is supported, pressure build-up to a first level against said obstructing element can be used to operate the tool and when said support is removed, said first seat allows said obstructing element to pass at a second pressure level substantially below said first level, 19. The apparatus of claim 18, further comprising:

a shifting sleeve movably mounted to said positioning means between a first position where said sleeve supports said first seat and a second position where said support is removed;

said sleeve operable by application of an unbalanced force from outside said positioning means.

20. The apparatus of claim 19, wherein said first seat further comprises:

an annularly shaped seat member having a taper toward its longitudinal axis which forms said seat;

said obstructing element further comprises a sphere;

said seat member formed having at least one cutout near said taper to facilitate plastic deformation of said taper to allow said sphere to pass when said shifting sleeve is in said second position.

21. The apparatus of claim 20, further comprising:

an annularly shaped support member circumscribing said seat member, said support member disposed against said shifting sleeve when said sleeve is in said first position;

said support member formed having at least one cutout substantially longer than said cutout on said seat member;

whereupon shifting of said shifting sleeve to said second position, said support member provides negligible resistance to plastic deformation of said seat member to let said sphere pass.

22. The apparatus of claim 21, wherein:

said support member and said seat member have a plurality of longitudinal cutouts extending from one end thereof, said cutouts on said support member substantially longer than said cutouts on said seat member, said cutouts on said seat member extend to a point short of said taper thereon.

23. The apparatus of claim 22, further comprising:

a second seat in said flowpath to engage said sphere after it passes said first seat, said reduced second pressure level enhancing sealing connection of said sphere to said second seat by reduction of sphere velocity at the point of contact with said second seat;

release means in said flowpath sensitive to flowpath pressure when said sphere is on said second seat for release of the tool.

24. A method of setting and releasing from a downhole tool, comprising:

running in the tool with tubing;

rotationally and longitudinally locking the tool to said tubing during run-in to prevent unintentional release;

actuating the tool;

disabling at least in part said rotational or longitudinal locking by said actuation;

said rotational locking further comprises:

trapping a first movable sleeve while a portion thereof extends into a receptacle in the tool;

said actuating step further comprises:

shifting a second sleeve from a first position where said first movable sleeve is locked, to a second position where said first sleeve is enabled to exit from said receptacle; and disabling said rotational locking by said shifting.

25. The method of claim 24, wherein:

moving said first sleeve out of said receptacle with fluid pressure;

hydraulically unbalancing said second sleeve by selective obstruction of a flowpath in said tubing.

26. The method of claim 24, further comprising the steps of:

selectively supporting a seat in said flowpath;

dropping an obstruction to seal off on said seat;

building pressure to a first level against said obstruction to create an unbalanced force on said second sleeve.

27. The method of claim 26, further comprising the steps of:

removing support for said seat;

applying a second level of pressure below said first level;

plastically deforming said seat with said second pressure level;

passing said obstruction past said seat.

28. The method of claim 27, further comprising the steps of:

catching said passed obstruction on another seat in said flowpath;

disabling said longitudinal locking by shifting a third sleeve with said obstruction on said second seat;

moving a piston with applied pressure outside said flowpath;

removing support for at least one collet engaging the tool;

disengaging said tubing from the tool by a longitudinal pull.

29. The method of claim 27, further comprising the steps of:

providing, as said support for said seat, a third movable sleeve;

providing as said seat a tapering, at least in part, annular member having at least one cutout near its taper.

30. The method of claim 29, further comprising the steps of:

providing a support member circumscribing said tapered member and selectively in contact with said third sleeve;

providing on said support member a plurality of longitudinal cutouts significantly longer than said cutout on said tapering member;

removing resistance offered by said support member to plastic deformation of said tapered member by hydraulic shifting of said third sleeve with pressure developed outside of said tubing.

31. A method of setting and releasing from a downhole tool, comprising:

running in the tool with tubing;

rotationally and longitudinally locking the tool to said tubing with discrete rotational and longitudinal locking mechanisms during run-in to prevent unintentional release;

actuating the tool;

disabling one of said rotational and longitudinal locks by said actuation.

32. The method of claim 31, wherein:

said rotational locking is disabled by said actuation.

* * * * *